US012004624B2

(12) United States Patent
Kim et al.

(10) Patent No.: US 12,004,624 B2
(45) Date of Patent: Jun. 11, 2024

(54) HAIR DRYER

(71) Applicant: LG ELECTRONICS INC., Seoul (KR)

(72) Inventors: Kyoungtae Kim, Seoul (KR); Hyunchul Kim, Seoul (KR); Yunhee Ku, Seoul (KR); Rayoung Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 830 days.

(21) Appl. No.: 17/077,119

(22) Filed: Oct. 22, 2020

(65) Prior Publication Data

US 2021/0315350 A1 Oct. 14, 2021

(30) Foreign Application Priority Data

Apr. 10, 2020 (KR) ..... 10-2020-0044038

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 2200/205; A61N 5/0617; A61N 2005/0626; A61N 2005/0644; H02J 50/10
See application file for complete search history.

(56) References Cited

U.S. PATENT DOCUMENTS

| | | | |
|---|---|---|---|
| 939,106 | A | 11/1909 | Soles |
| 2,560,808 | A | 7/1951 | MacCallum |
| 3,265,075 | A | 8/1966 | Edman |
| 5,275,339 | A | 1/1994 | Andis et al. |
| 5,568,691 | A | 10/1996 | Rubin |
| 5,715,847 | A | 2/1998 | Rolf |
| 6,070,597 | A | 6/2000 | Motherhead |
| D477,112 | S | 7/2003 | Yeung |
| 6,601,316 | B2 | 8/2003 | Shaw, II |

(Continued)

FOREIGN PATENT DOCUMENTS

| | | |
|---|---|---|
| CN | 1167430 | 12/1997 |
| CN | 203884936 | 10/2014 |

(Continued)

OTHER PUBLICATIONS

U.S. Office Action dated Apr. 6, 2023 issued in U.S. Appl. No. 17/077,927.

(Continued)

*Primary Examiner* — Shawntina T Fuqua
(74) *Attorney, Agent, or Firm* — KED & ASSOCIATES

(57) ABSTRACT

A hair dryer includes a main body, a handle, and a diffuser. The diffuser includes a diffusing case. The main body is provided such that a front end of an outer wall surrounds the gas outlet, a first coupling portion coupled with the diffuser is provided at the front end, and the diffusing case includes a second coupling portion coupled to the first coupling portion while surrounding a gas inlet hole defined at a rear side. The first coupling portion includes a wireless power transmitter to wirelessly supply power to the diffuser, and the second coupling portion includes a wireless power receiver to wirelessly receive the power from the wireless power transmitter.

20 Claims, 11 Drawing Sheets

(56) References Cited

U.S. PATENT DOCUMENTS

| | | | | |
|---|---|---|---|---|
| 7,040,037 | B2 | 5/2006 | Keong | |
| 7,380,347 | B2 | 6/2008 | Coats | |
| 7,946,056 | B2 | 5/2011 | Kroll | |
| 8,387,271 | B2 | 3/2013 | Shami et al. | |
| 8,434,238 | B2 | 5/2013 | Gross et al. | |
| 8,720,078 | B1 | 5/2014 | Behbehani | |
| 9,144,286 | B2 | 9/2015 | Courtney | |
| 9,498,039 | B2 | 11/2016 | Matsui | |
| 9,839,274 | B1 | 12/2017 | Brickner | |
| 9,936,788 | B2 | 4/2018 | Stephens et al. | |
| 10,165,843 | B2 | 1/2019 | Hedges | |
| 10,238,199 | B2 | 3/2019 | Stephens | |
| 10,278,471 | B2 | 5/2019 | Shelton et al. | |
| 10,470,545 | B2 | 11/2019 | Thiebaut | |
| 10,610,001 | B2 | 4/2020 | Kim | |
| 10,660,418 | B2 | 5/2020 | deGrood et al. | |
| 10,702,037 | B2 | 7/2020 | Boateng | |
| 10,869,529 | B2 | 12/2020 | Chia | |
| 10,874,186 | B2 | 12/2020 | MacPherson | |
| D935,688 | S | 11/2021 | Park | |
| 11,253,040 | B2 | 2/2022 | Kim | |
| 11,425,979 | B2 | 8/2022 | Conrad | |
| 11,457,713 | B2 | 10/2022 | Conrad | |
| 11,464,313 | B2 | 10/2022 | Wang | |
| 11,576,474 | B2 | 2/2023 | Kim | |
| 11,633,028 | B2 | 4/2023 | Kim | |
| 2003/0079367 | A1 | 5/2003 | Troletti | |
| 2009/0000141 | A1 | 1/2009 | Gross et al. | |
| 2015/0007442 | A1* | 1/2015 | Gammack | A45D 20/08 34/96 |
| 2016/0367006 | A1 | 12/2016 | Stephens et al. | |
| 2016/0367008 | A1 | 12/2016 | Stephens et al. | |
| 2017/0105501 | A1 | 4/2017 | Palmer | |
| 2018/0036553 | A1* | 2/2018 | Shiibashi | A45D 20/12 |
| 2019/0014880 | A1* | 1/2019 | deGrood | A45D 20/10 |
| 2021/0315350 | A1 | 10/2021 | Kim | |
| 2021/0315351 | A1 | 10/2021 | Kim | |
| 2021/0315353 | A1 | 10/2021 | Kim et al. | |
| 2021/0315354 | A1 | 10/2021 | Kim | |
| 2021/0315355 | A1 | 10/2021 | Kim | |
| 2021/0315356 | A1 | 10/2021 | Kim | |
| 2022/0304444 | A1* | 9/2022 | Wang | A45D 20/12 |

FOREIGN PATENT DOCUMENTS

| | | | | |
|---|---|---|---|---|
| CN | 104273918 | | 1/2015 | |
| CN | 107529865 | | 1/2018 | |
| CN | 109247685 | | 1/2019 | |
| CN | 106539271 | | 11/2019 | |
| CN | 209732900 | | 12/2019 | |
| CN | 217013050 | U * | 7/2022 | A45D 20/122 |
| FR | 2766338 | | 1/1999 | |
| GB | 2612788 | A * | 5/2023 | A45D 20/12 |
| JP | 01-055803 | | 4/1989 | |
| JP | 2012-019865 | | 2/2012 | |
| JP | 2012-239535 | | 12/2012 | |
| JP | 2013-162830 | | 8/2013 | |
| JP | 2018-015539 | | 2/2018 | |
| JP | 6346700 | | 6/2018 | |
| JP | 2018-134441 | | 8/2018 | |
| JP | 2018-175726 | | 11/2018 | |
| JP | 3222699 | | 8/2019 | |
| KR | 20-1985-0002139 | | 10/1985 | |
| KR | 10-1997-0706745 | | 12/1997 | |
| KR | 20-1998-0026628 | | 8/1998 | |
| KR | 10-2001-0086200 | | 9/2001 | |
| KR | 10-2010-0066043 | | 6/2010 | |
| KR | 20-2011-0002484 | | 3/2011 | |
| KR | 10-1056026 | | 8/2011 | |
| KR | 10-1155135 | | 6/2012 | |
| KR | 20-0468263 | | 8/2013 | |
| KR | 2016-502432 | | 1/2016 | |
| KR | 2016-072174 | | 5/2016 | |
| KR | 20-2016-0002206 | | 6/2016 | |
| KR | 10-2016-0095646 | | 8/2016 | |
| KR | 10-2015-0023773 | | 1/2017 | |
| KR | 10-1758360 | | 7/2017 | |
| KR | 10-2017-0139520 | | 12/2017 | |
| KR | 10-2017-0138806 | | 2/2018 | |
| KR | 10-2018-0017193 | | 2/2018 | |
| KR | 10-1872227 | | 6/2018 | |
| KR | 20-2018-0003263 | | 11/2018 | |
| KR | 10-2018-0130756 | | 12/2018 | |
| KR | 10-1928531 | | 12/2018 | |
| KR | 10-2019-0072169 | | 6/2019 | |
| KR | 10-1988303 | | 6/2019 | |
| KR | 10-2019-0084801 | | 7/2019 | |
| KR | 10-2020-0033086 | | 3/2020 | |
| KR | 10-2020-0033115 | | 3/2020 | |
| TW | 201914475 | | 4/2019 | |
| TW | 201914476 | | 4/2019 | |
| TW | 201936080 | | 9/2019 | |
| WO | WO 2011/100711 | | 8/2011 | |
| WO | WO 2020/165554 | | 8/2020 | |
| WO | WO 2021/090155 | | 5/2021 | |

OTHER PUBLICATIONS

Taiwanese Notice of Allowance dated Apr. 28, 2022 issued in Application No. 109137300 (English translation attached).
International Search Report issued in Application No. PCT/KR2020/012282 dated Jul. 22, 2021.
International Search Report issued in Application No. PCT/KR2020/012288 dated Jul. 26, 2021.
International Search Report issued in Application No. PCT/KR2020/012272 dated Jul. 22, 2021.
International Search Report issued in Application No. PCT/KR2020/012273 dated Jul. 22, 2021.
International Search Report issued in Application No. PCT/KR2020/012284 dated Jul. 22, 2021.
International Search Report issued in Application No. PCT/KR2020/012286 dated Jul. 22, 2021.
International Search Report issued in Application No. PCT/KR2020/012292 dated Jul. 22, 2021.
International Search Report issued in Application No. PCT/KR2020/012289 dated Jul. 27, 2021.
Korean Office Action issued in Application No. 10-2020-0044041 dated Aug. 6, 2021.
Taiwan Office Action issued in Application No. 109137300 dated Aug. 13, 2021.
Taiwan Office Action issued in Application No. 109136742 dated Aug. 13, 2021.
Taiwan Office Action issued in Application No. 109136743 dated Aug. 13, 2021.
Taiwan Office Action issued in Application No. 109136745 dated Aug. 13, 2021.
Taiwanese Notice of Allowance dated Jan. 5, 2022 issued in Application No. 109136741 (English translation attached).
United States Office Action dated Apr. 25, 2022 issued in co-pending related U.S. Appl. No. 17/077,917.
United States Office Action dated Apr. 26, 2022 issued in co-pending related U.S. Appl. No. 17/077,921.
U.S. Office Action dated Sep. 23, 2022 issued in U.S. Appl. No. 17/077,917.
U.S. Appl. No. 17/077,915, filed Oct. 22, 2020.
U.S. Appl. No. 17/077,917, filed Oct. 22, 2020.
U.S. Appl. No. 17/077,921, filed Oct. 22, 2020.
U.S. Appl. No. 17/077,922, filed Oct. 22, 2020.
U.S. Appl. No. 17/077,927, filed Oct. 22, 2020.
U.S. Appl. No. 17/077,929, filed Oct. 22, 2020.
U.S. Appl. No. 17/077,119, filed Oct. 22, 2020.
U.S. Office Action dated May 1, 2023 issued in U.S. Appl. No. 17/077,915.
United States Notice of Allowance dated Oct. 12, 2022 issued in co-pending related U.S. Appl. No. 17/077,921.
U.S. Appl. No. 17/085,385, filed Oct. 30, 2020.
Taiwanese Notice of Allowance dated Oct. 18, 2021 issued in TW Application No. 109136744.

(56) References Cited

OTHER PUBLICATIONS

Korean Notice of Allowance dated Nov. 16, 2021 issued in KR Application No. 10-2020-0044040.
Korean Notice of Allowance dated Nov. 18, 2021 issued in KR Application No. 10-2020-0044038.
U.S. Office Action dated Jul. 27, 2022 issued in U.S. Appl. No. 17/077,922.
U.S. Office Action dated Jul. 20, 2022 issued in U.S. Appl. No. 17/077,929.

* cited by examiner

HAIR DRYER

CROSS-REFERENCE TO RELATED APPLICATION(S)

This application claims the benefit of Korean Patent Application No. 10-2020-0044038, filed in Korea on Apr. 10, 2020, which is hereby incorporated by reference as if fully set forth herein.

BACKGROUND

1. Field

The present disclosure relates to a hair dryer including a diffuser.

2. Background

When removing moisture from wet hair or when styling hair, a hair dryer that discharges gas through a gas outlet may be used. In one example, the hair dryer may provide air or gas having certain characteristics desired by a user, such as a desired gas temperature, a desired gas speed, and a desired gas flow shape or area, through a diffuser. The diffuser may be coupled to a main body of the hair dryer to change the gas characteristics. Further, the diffuser may include a care device such as massage protrusions or bristles to manage scalp health and the like.

Korean Utility Model Application Publication No. 20-2011-0002484 discloses a diffuser coupled to a main body of the hair dryer to discharge gas. In the structure of coupling the diffuser to the main body, a possibility of unintended or accidental separation between the diffuser and the main body may be reduced. The diffuser and the main body may transmit and receive power and signals while simultaneously providing ease of use and stability to a user by securing a stable fixing force in the coupled state.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
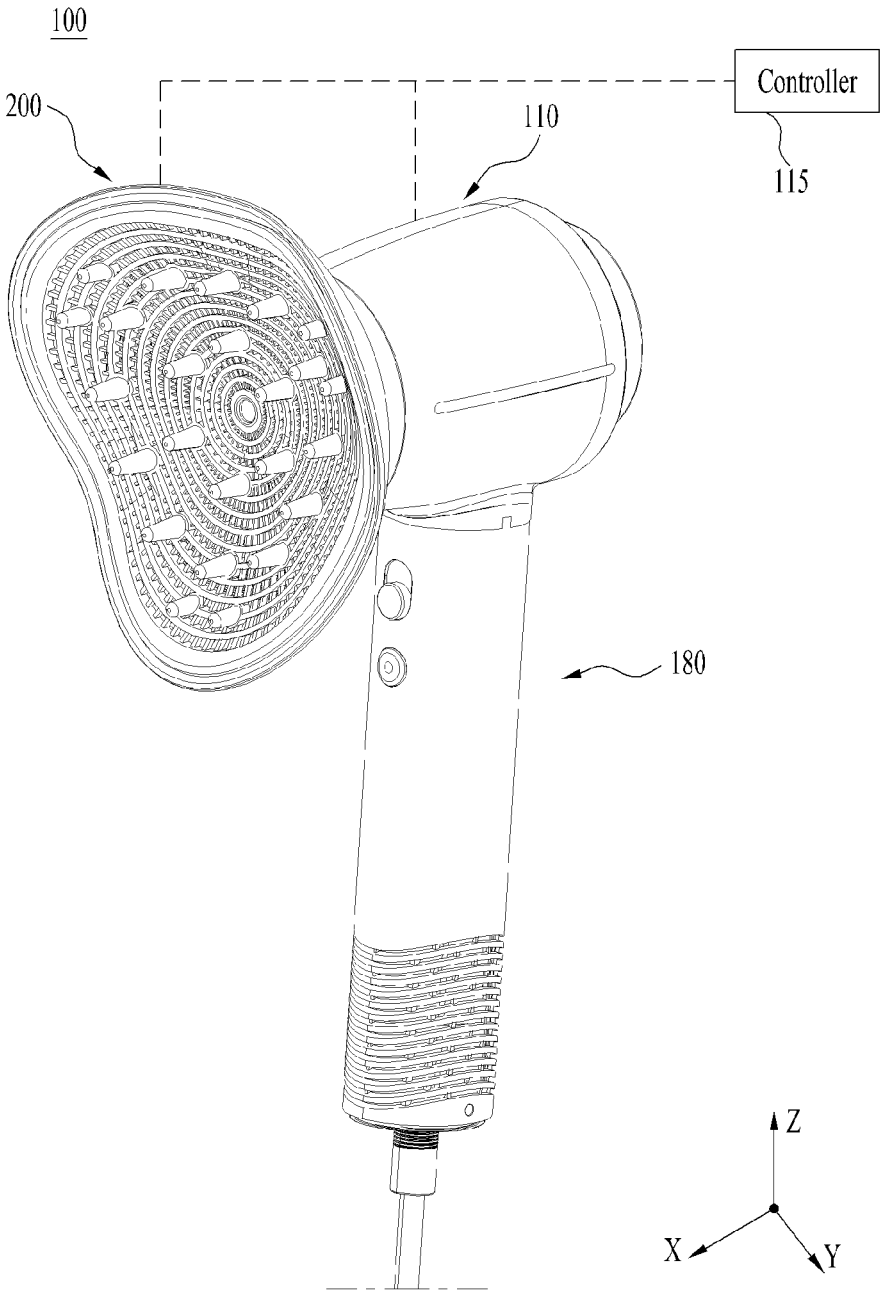
FIG. 1 is a view showing a hair dryer according to an embodiment.
Figure 2:
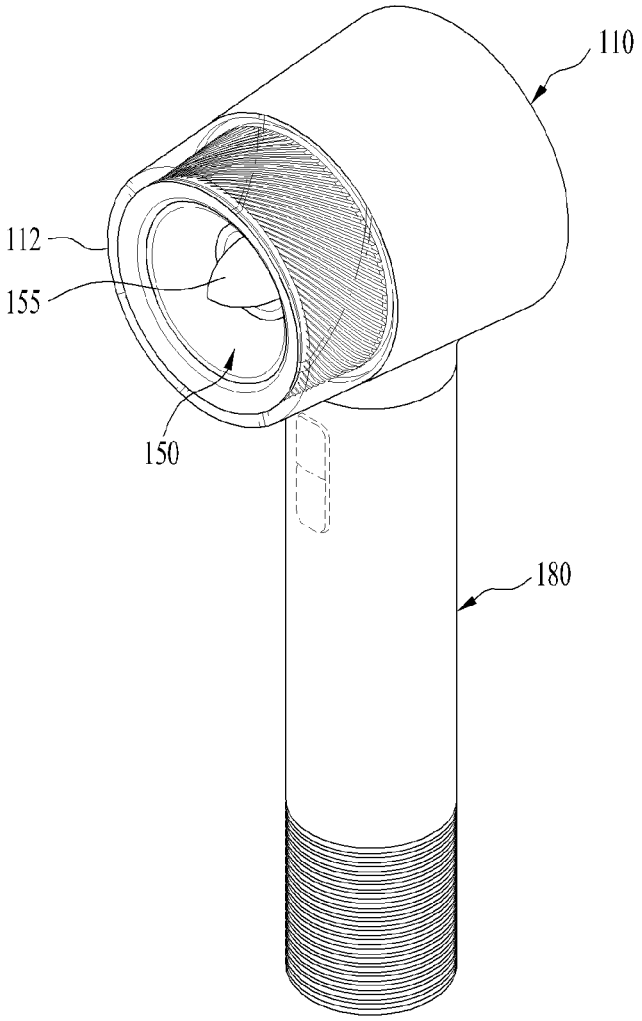
FIG. 2 is a view showing a state in which a diffuser is separated from the hair dryer shown in FIG. 1.
Figure 3:
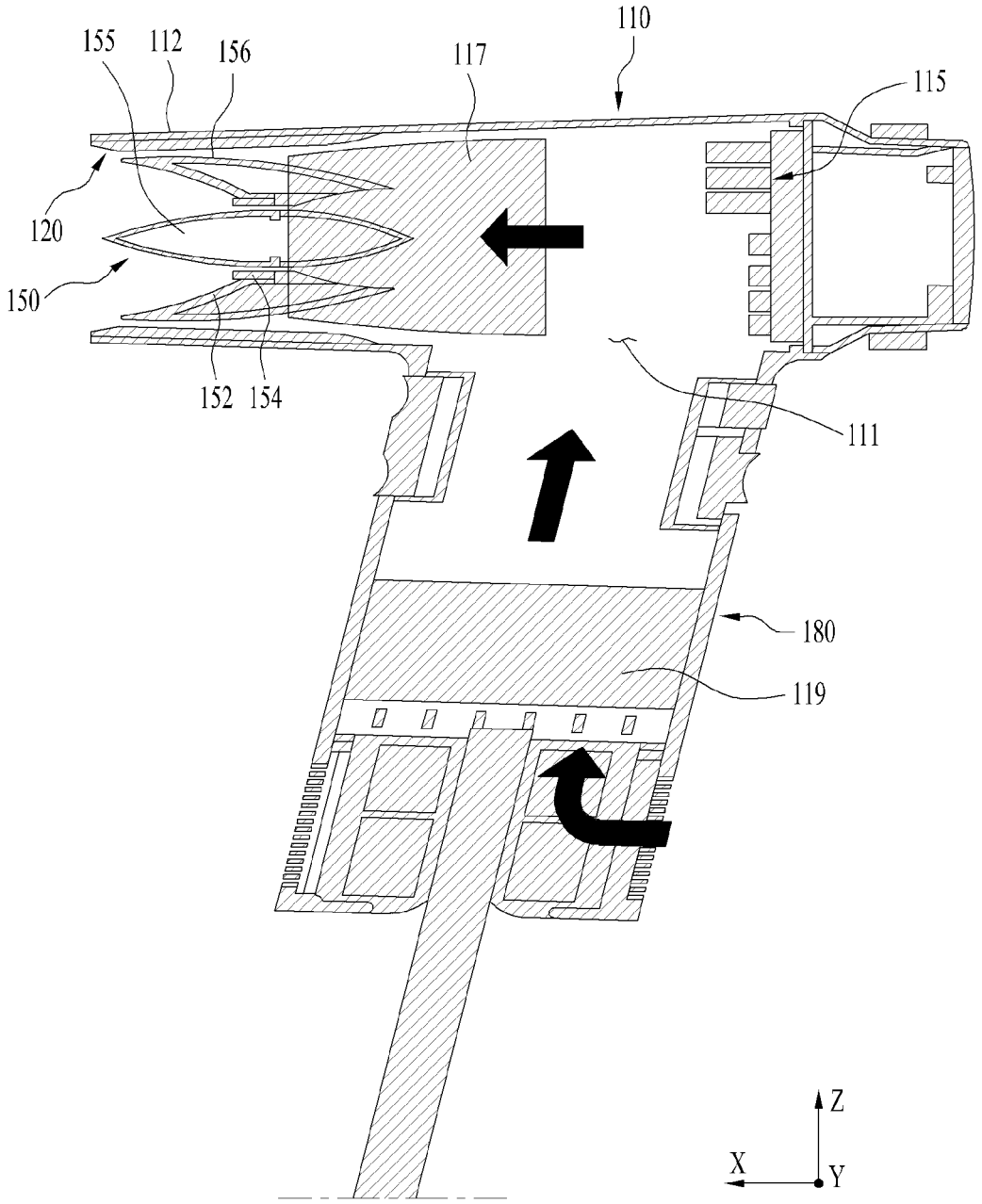
FIG. 3 is a view showing an internal cross-section of the hair dryer shown in FIG. 2.

Referring to FIGS. 1-3, a hair dryer 100 may include a main body 110, a handle 180, and a diffuser 200 as shown in FIG. 1. In addition, as shown in FIG. 2, the main body 110 may include a gas or air outlet 150 through which gas or air introduced from outside is discharged.

As shown in FIG. 3, the main body 110 may include a gas or air flow path 111 through which the introduced gas flows. The gas inside of the gas flow path 111 may be discharged through the gas outlet 150 to the outside. The main body 110 may have an extended shape along a front-rear direction and may have various cross-sectional shapes such as circular, elliptical, stadium, or polygonal shapes when viewed from the front.

In the present disclosure, front, rear, left, right, top, and bottom definitions may be made centering on the main body 110. Referring to FIG. 2, the gas outlet 150 may be provided at a front side of the main body 110, and the handle 180 may have a shape extending substantially downward from the main body 110.

The gas flowing inside the main body 110 may be introduced through a gas inlet, which may be provided on the handle 180 (as shown in FIG. 3) or alternatively on the main body 110 (for example, at a rear of the main body 110). As shown in FIGS. 1 to 3, when the gas inlet is provided on the handle 180, the gas flow path 111 may extend from gas inlet formed in the handle 180 toward the gas outlet 150 of the main body 110, or upward and frontward. The gas may be introduced or suctioned from the outside through the gas inlet, and the introduced gas may flow along the gas flow path 111 and be discharged to the outside through the gas outlet 150.

The handle 180 may be a portion of the hair dryer 100 grabbed by a hand of a user, and may have a shape that improves grip convenience. The handle 180 may extend downward from the main body 110, as illustrated in FIGS. 1 to 3, but embodiments disclosed herein are not limited to a downward handle 180. The handle 180 may be integrally molded with the main body 110, or separately manufactured from the main body 110 and later coupled to the main body 110.

When the handle 180 is manufactured separately from the main body 110 and later coupled to the main body 110, the handle 180 may be provided such that a longitudinal direction thereof with respect to the main body 110 is fixed or variable. For example, the handle 180 may have a hinge coupling portion or hinge structure, and may be coupled to the main body 110 such that the longitudinal direction of the handle 180 is changeable (e.g., foldable) relative to the main body 110 so as to make grasping and/or styling convenient.

The extending direction of the handle 180 may vary. However, for convenience of description below, the direction in which the handle 180 extends from the main body 110 will be described as a downward direction.

Referring to FIG. 3, the hair dryer 100 according to an embodiment may include a fan 119 capable of moving (e.g., suctioning and/or discharging) gas or air and adjusting a speed of the gas or air discharged through the gas outlet 150.

The fan 119 may be provided in the gas flow path 111 to blow the gas. The fan 119 may be provided inside the handle 180 (as illustrated) or alternatively inside of the main body 110 (e.g., a rear of the main body 110).

The fan 119 may be provided near or adjacent to the gas inlet. For example, when the gas inlet is provided in the handle 180, the gas flow path 111 may extend from the gas inlet of the handle 180 to the gas outlet 150, and the fan 119 may be provided in a portion of the gas flow path 111 located in the handle 180.

A temperature adjuster 117 (e.g., a heater or cooler) may be provided inside of the main body 110 (or alternatively, the handle 180) to adjust a temperature of the discharged gas. The temperature adjuster 117 may be provided in various forms and may be provided at various positions. In FIG. 2, the temperature adjuster 117 is provided inside the main body 110.

In addition, the temperature adjuster 117 may be provided in various types. The temperature adjuster 117 may use a heating scheme by providing current to a coil-shaped resistor to generate heat. However, the resistor of the temperature adjuster 117 may not necessarily be in the shape of the coil, and may be provided in various types, such as a thermoelement capable of heating the gas or adjusting the temperature of the gas. As another example, the temperature adjuster 117 may include a thermoelectric cooler (TEC) or Peltier device to provide cool air.

A method for operating the hair dryer 100 according to an embodiment of the present disclosure will be schematically described with respect to gas or air flow.

First, the user may manipulate or operate a power button provided on the main body 110 or the handle 180. When the power button is turned on, the fan 119 may be operated, and gas may be introduced or suctioned into the hair dryer 100.

The gas introduced through the gas inlet flows along the gas flow path 111 via the fan 119 toward the gas outlet 150, and the gas is discharged through the gas outlet 150 to the user. In this process, a flow speed of the gas along the gas flow path 111 may be adjusted by the fan 119, and a temperature of the gas flowing along the gas flow path 111 may be adjusted by the temperature adjuster 117.

In one example, the hair dryer 100 according to an embodiment may include a controller 115. The controller 115 may be connected not only to the fan 119, the temperature adjuster 117, the power button, and a manipulator or user interface to select a desired temperature or flow speed, but also to a light irradiator or light 260 (FIG. 6), a proximity sensor 269 (FIG. 6), a moisture measurement protrusion or sensor 312 (FIG. 6), and the like, which may be provided on the diffuser 200 and to be described later. The controller 115 may control the above described components.

The controller 115 may be provided on one of the diffuser 200, the main body 110, or the handle 180. Alternatively, a plurality of controllers 115 may be respectively arranged on all of the diffuser 200, the main body 110, and the handle 180. As indicated in FIG. 3, the controller 115 may be provided on the main body 110 to be signally connected to the diffuser 200, or, as indicated by the dotted lines in FIG. 1, a plurality of controllers 115 may be respectively arranged on the diffuser 200 and the main body 110.

Figure 6:
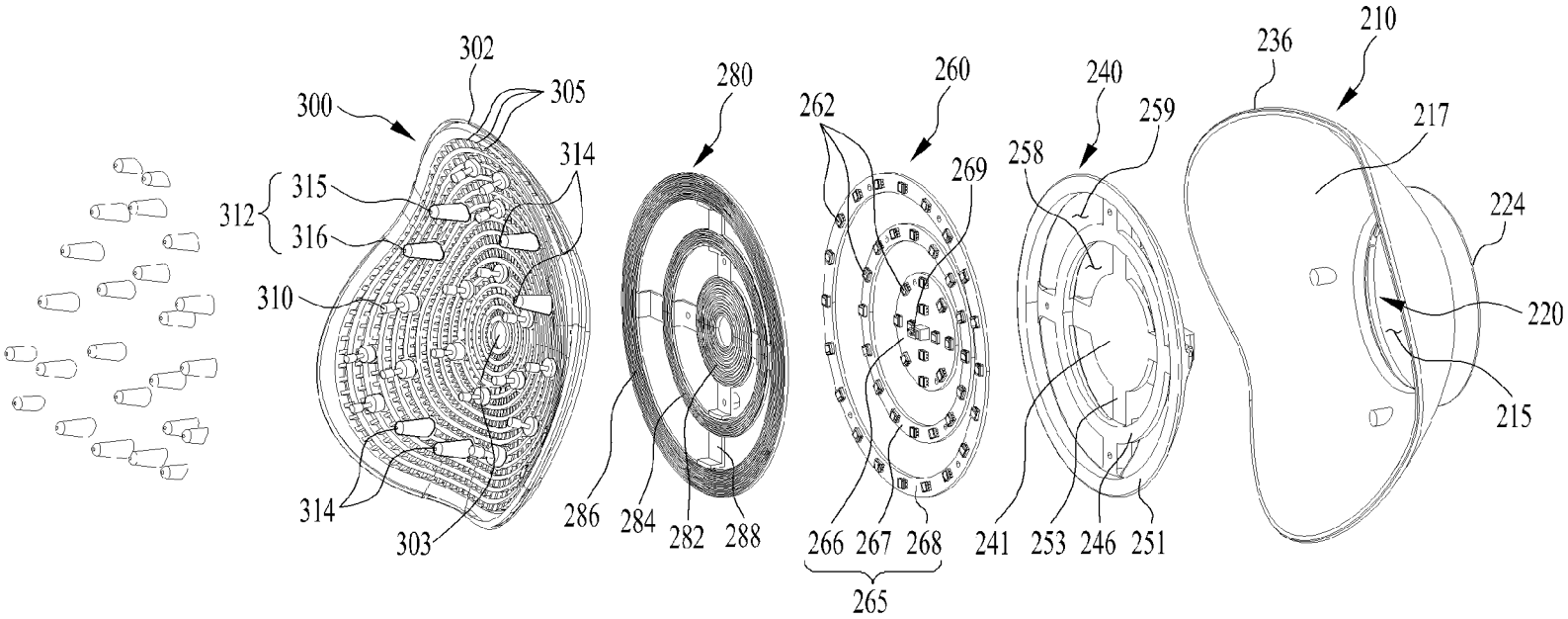
FIG. 6 is a view showing an exploded view of a diffuser according to an embodiment.

Adjusting operating states of the fan 119 and the temperature adjuster 117 may be performed by manipulation of the manipulator or user interface by the user or may be automatically performed based on an operation mode preset or predetermined in the controller 115. In addition, when a distance to a target located in front of the diffuser 200 is identified to be equal to or less than a reference or predetermined distance through the proximity sensor 269 of the diffuser 200, the controller 115 may control the light irradiator 260 of the diffuser 200 to irradiate light (FIG. 6).

The controller 115 may identify an impedance of the target located in front of the diffuser 200 through the moisture measurement protrusion 312 of the diffuser 200, and determine a moisture amount of the target through the impedance. As the moisture amount increases, the controller 115 may control the fan 119 such that the speed of the gas discharged through the gas outlet 150 increases, control the temperature adjuster 117 such that the gas temperature increases, or control the light irradiator 260 such that a light amount of the light irradiator 260 increases.

As shown in FIG. 1 or 3, the main body 110, where the gas outlet 150 is provided, may have a cross-section in an approximately circular shape and may have a front-rear length that is longer than a left-right width or diameter of the cross-section. However, the cross-section shape of the main body 110 may be varied as needed.

Figure 4:
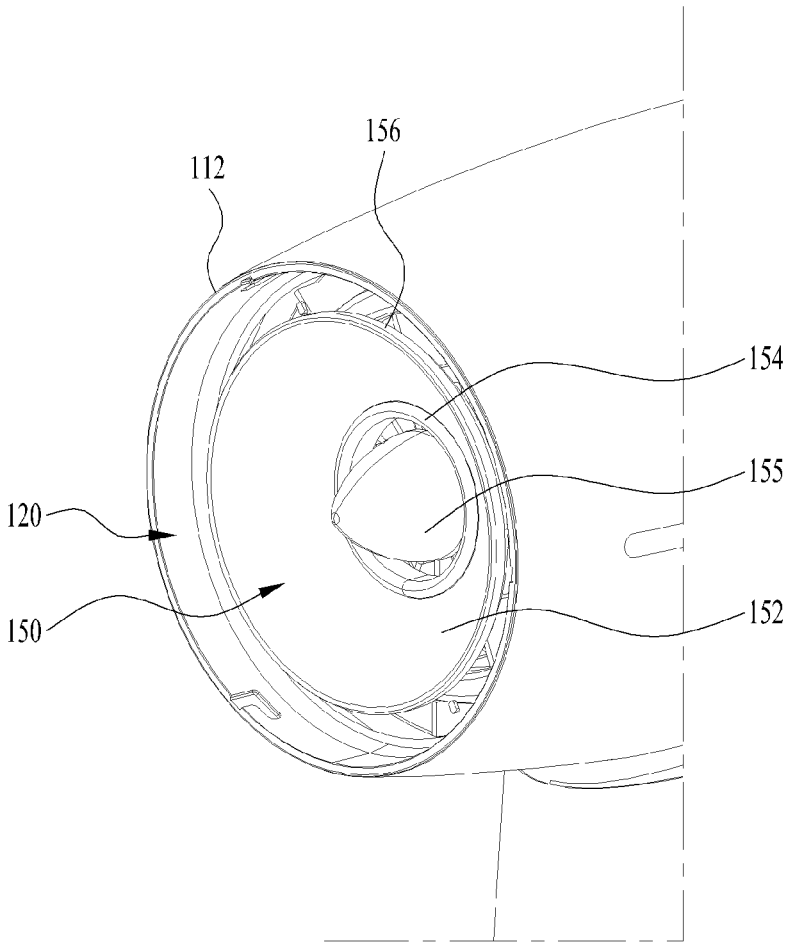
FIG. 4 is a view showing a gas outlet of a hair dryer according to an embodiment.

The gas outlet 150 of the hair dryer 100 according to an embodiment of the present disclosure will be described in detail with reference to FIG. 3. At least a portion of the gas flow path 111 may be defined inside the main body 110, and at least one side of the main body 110 may be opened or have an opening. For example, the main body 110 may extend in the front and rear direction, and a front surface thereof may be opened at a front end 112 (FIG. 4). The front end 112 may be a wall or front rim defining a front opening. The front opening of the main body 110 may be in communication with the gas flow path 111. The gas outlet 150 may be defined by an inner rim or surface of the front end 112. The front opening of the main body 110 may correspond to an end of the gas flow path 111, and the end of the gas flow path 111 may correspond to the gas outlet 150.

Referring to FIG. 4, in one example, the gas outlet 150 may include a discharge base or disc 152, which may be provided at the front opening of the main body 110. The discharge base 152 may be concentric with or provided inside of the front end 112. An outer edge of the discharge base 152 may be spaced apart from the front end 112 to define a side portion or opening 156 therebetween. The discharge base may have a center portion or opening 154. Gas may be discharged through the side and center openings 154 and 156, which may alternatively be referred to as outer and inner openings. The gas flowing along the gas flow path 111 may be simultaneously delivered to the center opening 154 and the side opening 156 to be discharged to the outside.

The center opening 154 and the side opening 156 may correspond to discharge holes through which the gas is discharged from the gas outlet 150. The center opening 154 may be defined at a central side on the cross-section of the gas outlet 150, and a cross-sectional shape thereof may be circular. However, embodiments disclosed herein are not limited to circular cross-sections, and a shape of the center opening 154 may be a polygonal shape such as a square as needed, and a size of a diameter, width, or cross-sectional area thereof may also be varied as needed.

The side opening 156 may surround the center opening 154. For example, as shown in FIG. 4, the center opening 154 may be defined in a substantially circular shape at the center of the discharge base 152 and/or a center of the entire gas outlet 150, and the side opening 156 may be an opening in a shape of a ring surrounding the discharge base 152. The ring shape may have an extended shape and/or a closed curve shape. For example, FIG. 4 discloses the side opening 156 having a circular ring shape. However, the ring shape of the side opening 156 may not necessarily be circular, and may be, for example, a polygonal ring shape such as a triangle or a square.

An optional guide cone 155 may be provided inside of the center opening 154 such that gas flows through a ring-shaped opening defined between, on the one hand, an inner side of the discharge base 152 defining the center opening 154, and, on the other hand, an outer surface of the guide cone 155. Details of the discharge base 152 and guide cone 155 will be described later. Like the shape of the side opening 156, the shape of the portion of the center opening 154 outside of the guide cone 155 is not limited to a circular ring shape, and may be, for example, a polygonal ring shape such as a triangle or a square.

The center opening 154 and the side opening 156 may be in communication with a same portion of the gas flow path 111. The center opening 154 may be concentric with the side opening 156.

A cross-sectional area of the entirety of the discharged gas may correspond to a size of an entire cross-section formed by the front end 112. However, The discharge base 152 may block a portion of the gas flowing through the gas outlet 150. The discharged gas may be diffused while flowing through the side opening 156, and a portion of the gas flow may be distributed toward a center of the cross-section where the gas is not discharged (i.e., toward the discharge base 152), and thus, the cross-sectional area of the discharge gas may be reduced.

The center opening 154 may be defined at a center of the side opening 156, and the gas of the side opening 156 that is distributed toward the center of the discharge base 152 may be suppressed by gas discharged through the center opening 154. The gas flowing through the center opening 154 may suppress the gas flowing through the side opening 156 and prevent the gas flowing through the side opening 156 from being distributed toward the center of the gas outlet 150.

Gas flowing through the center and side openings 54 and 156 may have a large cross-sectional area, facilitating a drying process. For example, an entire volume of gas discharged through the center opening 154 and the side opening 156 may be sufficient to allow the user to dry a larger area.

Since the center opening 154 and the side opening 156 may be in communication with the same cross-sectional area of the gas flow path 111, there may not necessarily be separate gas flow paths 111 for the center opening 154 and the side opening 156. Thus, provided three-dimensional gas discharge to the user may be efficient.

The center opening 154 may be defined at a center of the discharge base 152, and the side opening 156 may be defined between an outer circumferential surface of the discharge base 152 and the front end 112 of the main body 110, which may be a wall or rim defining the front opening.

The discharge base 152 may be coupled to the front end 112 of the main body 110 and may have a same cross-sectional shape of the front opening, but embodiments disclosed herein are not be limited thereto and may be formed in various shapes or materials. For example, the discharge base 152 may be provided to be partially different from the shape of the front opening of the main body 110 to determine the shape of the side opening 156, and may be molded with a material that is the same as or different from a material of the front end 112 or outer wall of the main body 110.

The discharge base 152 may constitute an entirety or a portion of one surface (e.g., the front surface) of the main body 11, so that the center opening 154 may be defined at the center of the discharge base 152, and the side opening 156 may be defined between the outer circumferential surface of the discharge base 152 and the front end 112 of the main body 110.

The discharge base 152 may be coupled to an opening of the main body 110 in various schemes, such as a scheme using a plurality of coupling ribs and/or may be integrally molded with the main body 110.

In one example, as shown in FIG. 4, the discharge base 152 may be indented or recessed toward an interior of the main body 110 from the front end 112 such that a front rim of the front end 112 protrudes further forward than a front surface of the discharge base 152.

Furthermore, a center of the front surface of the discharge base 152 may be indented or recessed toward the interior of the main body 110 such that the front surface of the discharge base 152 may form a curved or bent surface. Accordingly, the gas discharged through the center opening 154 may be discharged upstream or before the gas discharged through the side opening 156.

When the gas discharged through the center opening 154 starts to be diffused prior to the gas discharged through the side opening 156, the cross-sectional area of the gas discharged through the central opening 154 may be increased through diffusion, and may suppress a flow of the gas discharged through the side opening 156 toward a center. Further, a curvature of the curved surface of the front surface of the discharge base 152 may be variously set as necessary to prevent or reduce turbulence.

A guide cone 155 may be provided at a center of the center opening 154 to guide a flow of the gas discharged through the center opening 154. The gas may be discharged between an inner surface of the center opening 154 and the guide cone 155.

FIG. 4 illustrates the guide cone 155 provided at the center of the center opening 154. As the guide cone 155 is provided, the gas flowing through the center opening 154 is discharged into a space between the inner surface of the center opening 154 and an outer surface of the guide cone 155.

When the guide cone 155 is provided at the center of the center opening 154, the gas may flow through an outer portion of the center opening 154, which may be a ring-shaped discharge hole. The gas discharged through the center opening 154 may have a ring-shaped cross-section.

The gas discharged through the center opening 154 may contribute to suppressing a reduction of a cross-sectional area of the gas discharged through the side opening 156 by blocking some gas discharged through the side opening 156 from flowing toward inward toward a center in the flow process. In addition, the guide cone 155 may increase a level or speed at which the gas discharged through the center opening 154 diffuses outward.

When the cross-sectional area of the gas discharged through the center opening 154 is increased due to the guide cone 155, the suppression of inward flow of gas discharged through the side opening 156 may be increased.

In one example, in the guide cone 155, a rear end protruding toward the gas flow path 111 and a front end protruding in a discharge direction of the gas of the center opening 154 may respectively have conical shapes. The conical shape may mean a shape in which a cross-sectional area has a circular or elliptical shape, and where a diameter or width of the circle gradually decreases as a length increases.

However, in the conical shape, the circular shape of the cross-sectional area is not limited to perfect circles and may have, for example an ellipse or stadium shape. Furthermore, a reduction in the diameter may not necessarily be constant; for example, a diameter reduction rate may gradually increase or gradually decrease.

As the front end of the guide cone 155 protrudes in the conical shape, the gas discharged through the center opening 154 may be increasingly concentrated toward a rim of the center opening 154. Thus, a flow of the gas discharged through the side opening 156 and flowing toward the center opening 154 may be further suppressed.

An outer circumferential surface of the guide cone 155 may have a shape or size corresponding to an inner circumferential surface of the center opening 154, and a separation distance between the outer circumferential surface of the guide cone 155 and the inner circumferential surface of the center opening 154 may be varied as needed. Further, the guide cone 155 may be made of a material the same as or different from the material of the discharge base 152, and a curvature of the outer surface thereof may be variously designed as needed.

In one example, the gas outlet 150 may further include a discharge guide ring. The discharge guide ring may be provided on the inner surface of the center opening 154 and protrude in the discharge direction of the gas discharged through the center opening 154 to guide the gas flow together with the guide cone 155. FIG. 4 illustrates that the guide cone 155 and the discharge guide ring may be arranged in the center opening 154.

The discharge guide ring may have a ring shape extending along the rim of the center opening 154, and may be integrally molded with the discharge base 152 or molded separately from the discharge base 152 to be later coupled to the inner circumferential surface of the center opening 154.

The discharge guide ring may protrude outward or forward and rearward from the center opening 154 or the discharge base 152 and/or protrude based on the gas discharge direction. The flow of the gas through the center opening 154 may be concentrated between the guide cone 155 and the discharge guide ring by the guide cone 155 and the discharge guide ring protruding from the center opening 154. A protruding end of the discharge guide ring may have a curved shape to facilitate the gas flow. A diameter of the discharge guide ring may be different for each portion, and a shape thereof may also be varied as needed. The front end 112 of the main body 110 may include a first coupling member 120 described later.

Figure 5:
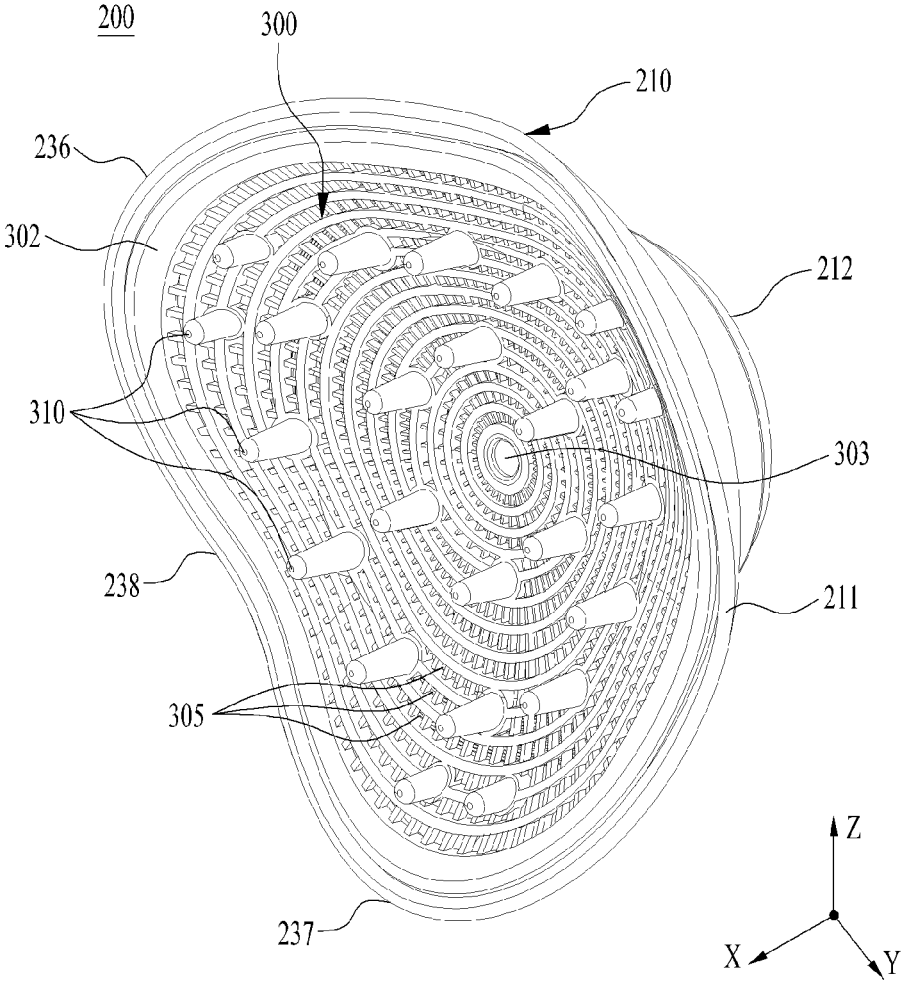
FIG. 5 is a view showing a diffuser according to an embodiment.

Referring to FIGS. 5 and 6, the diffuser 200 may be removably coupled to the main body 110 so that the gas discharged from the gas outlet 150 may be introduced into the diffuser 200 and to be discharged to the outside of the hair dryer 100. The diffuser 200 may alternatively be referred to as a head or nozzle head.

The diffuser 200 may be coupled to the main body 110 such that a rear side thereof covers the gas outlet 150, and the gas discharged from the gas outlet 150 may flow into the diffuser 200 through a gas inlet hole 215 defined at a rear side of the diffuser 200.

The user may selectively use the diffuser 200 for scalp or hair management. For example, the user may use a diffuser 200 including a massage protrusion or bristle 310 and a light irradiator or light 260, which will be described later, for scalp care. The user may also use the same diffuser 200 to dry hair, and a shape of the diffuser 200 may be configured such that a flow of a cross-sectional area of the gas is increased as needed in a hair drying step.

The rear side of the diffuser 200 may be coupled to the front end 112 of the main body 110. A first coupling portion or member 120 (FIG. 4) may be provided at the front end 112 of the main body 110, and a second coupling portion or member 220 configured to be coupled to the first coupling portion 120 may be provided at the rear side of the diffuser 200.

A coupling scheme between the diffuser 200 and the main body 110 may vary. The diffuser 200 may be coupled to the main body 110 in a scheme such as screw coupling, fitting coupling, magnetic coupling, or sliding coupling to receive the gas from the main body 110.

An embodiment of the present disclosure may improve ease of use of the user as the diffuser 200 is provided to be removable from the main body 110. For example, the user may remove the diffuser 200 when the user desires to use more concentrated gas discharged directly from the gas outlet 150 of the main body 110. Further, the user may add the diffuser 200 to the main body 110 when the user wants a more diffused or dispersed flow of gas.

The diffuser 200 may include a diffusing case 210 and a discharge or diffuser cover 300. The diffusing case 210 and a discharge cover 300 may form an exterior of the diffuser 200.

The diffuser may have a curved bell shape or hat shape. An inner diameter of the diffuser 200 may increase in a forward direction. An internal cross-sectional area of the diffusing case 210 and discharge cover 300 increases from a rear side or end 212 to a front side or rim 211.

Accordingly, gas delivered from the gas outlet 150 may be provided to the user in a state in which a flow cross-sectional area thereof is increased as the gas speed is reduced in the forward direction of the diffuser 200. The user may use the diffuser 200 for natural drying, styling, etc. for hair.

The front side 211 of the diffusing case 210 may be opened to define an open front surface. An entirety or a portion of the front surface of the diffusing case 210 may define the open surface. The gas present inside the diffuser 200 may be discharged to the outside through the open surface of the diffusing case 210 and be provided to the user while being discharged forward through the front side 211.

The open surface defined at the front side 211 of the diffusing case 210 may be exposed to the outside, or the discharge cover 300 may be provided to be coupled to the open surface.

FIG. 5 shows a state in which the discharge cover 300 is coupled to the open surface. The discharge cover 300 may include at least one gas discharge hole 305 defined therein through which the gas may be discharged. The discharge cover 300 may have a shape corresponding to the open surface of the diffusing case 210 and may be coupled to the diffusing case 210 to be located on or at the open surface.

A plurality of gas discharge holes 305 may be defined and may be spaced apart from each other in the front surface of the discharge cover 300. FIG. 5 shows a plurality of gas discharge holes 305 that are uniformly distributed and arranged in the front surface of the discharge cover 300. In such an arrangement, gas may be discharged through an entirety of the front surface of the discharge cover 300, and the user may receive gas that is discharged forward through the discharge cover 300 and more uniformly dispersed.

The discharge cover 300 may be provided such that an edge 302 located on the outermost side with respect to a radial direction of the diffuser 200 is in close contact with the diffusing case 210. The diffusing case 210 may have a front circumferential portion or rim 236 surrounding the open surface in the front side 211, and the edge 302 may have a shape corresponding to that of the front circumferential portion 236 and may be in contact with the front circumferential portion 236.

The front circumferential portion 236 may have a first portion 237 and a second portion 238. The first portion 237 and the second portion 238 may be arranged with different distances from the gas inlet hole 215 and/or rear side 212 of the diffusing case 210. The first and second portions 237 and 238 may represent various curves or waves defined by an outer edge of the diffusing case 210. The first portion 237 may be a hump or mountain and the second portion 238 may be a valley such the front circumferential portion 236 is further forward at the first portion 237 than at the second portion 238.The edge 302 of the discharge cover 300 may be molded to correspond to shapes of the first portion 237 and the second portion 238 so as to be in close contact with the front circumferential portion 236 of the diffusing case 210.

The front circumferential portion 236 of the diffusing case 210 and the edge 302 of the discharge cover 300 may be designed to fit over or on a head of the user with an arbitrary curved surface while respectively having curvatures and having different lengths protruding forward along an outer circumferential direction of the diffuser 200. Accordingly, a proximity or molding with the scalp or the hair of the user may be efficiently increased to minimize a space between the head of the user and the diffuser 200, thereby increasing a heating, drying, or treating effect. An amount of gas discharged forward through the discharge cover 300 and/or an amount or intensity of light provided by the light irradiator 260 may be efficiently increased.

An ergonomic design is made through the front circumferential portion 236 of the diffusing case 210 and the edge 302 of the discharge cover 300, which may be arranged to form curves when viewed from the side as described above and shown in the figures. In this case, the curvatures and the like of the front circumferential portion 236 and the edge 302 may be designed based on a standard head that is statistically determined.

For example, an embodiment of the present disclosure may define a R127 curvature design from a shape of the standard head, and design the shapes of the front circumferential portion 236 and the edge 302, and an overall shape of the diffusing case 210 and discharge cover 300, to correspond thereto.

In one example, a proximity or distance sensor 269 may be provided inside the diffusing case 210 to improve ease of use and efficiency of the diffuser 200. An open region or hole 303 may be defined in the discharge cover 300 such that a distance measurement accuracy of the proximity sensor 269 for a target in front of the diffuser 200 (e.g., the hair or the scalp of the user) may be improved. The proximity sensor 269 may be implemented in various schemes such as pressure, ultrasound, infrared, laser, light, etc. to measure a distance to the target in front of the proximity sensor 269, and a region of the discharge cover 300 in front of the proximity sensor 269 may be opened to define the open region 303.

In one example, FIG. 5 shows a discharge cover 300 having a plurality of massage protrusions or bristles 310. The massage protrusions 310 may have a pillar shape protruding forward from the diffuser 200 and may press the scalp of the user to provide a massage effect. A cross-sectional shape, a protruding length, an arrangement form, and the like of the massage protrusions 310 may be variously determined in terms of a design. An embodiment of the present disclosure provides the user with scalp massage through the massage protrusions 310 while also providing the gas diffused through a front surface of the discharge cover 300 to the user, thereby providing the improved ease of use and facilitating scalp and hair care.

Figure 7:
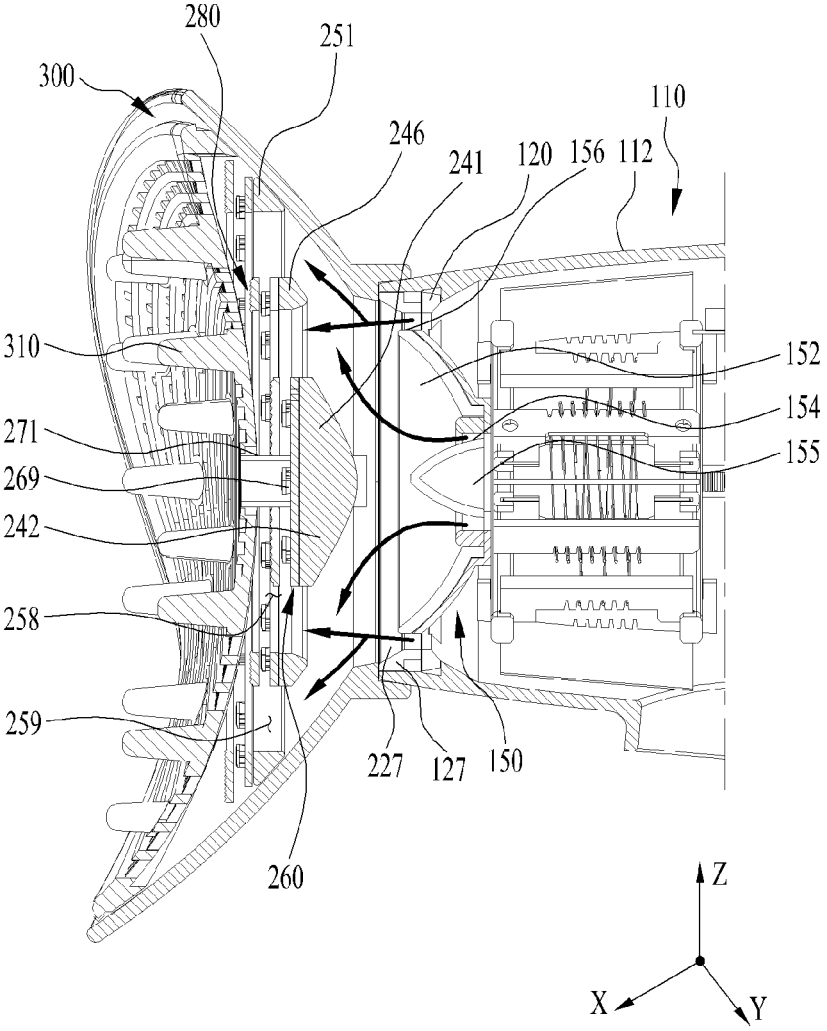
FIG. 7 is a view showing an internal cross-section of a diffuser according to an embodiment.

Referring to FIGS. 6 and 7, the diffuser 200 may include the diffusing case 210, a guide frame 240, the light irradiator 260, a light diffusion frame 280, and the discharge cover 300. A rear side 212 of the diffusing case 210 may be coupled with the main body 110, and the open surface may be defined in the front side 211. The inner diameter of the diffusing case 210 may increase from the rear side 212 to the front side 211 so that the gas exiting the main body 110 may be diffused and discharged to the outside. The gas discharged through the gas outlet 150 of the main body 110 may be provided to the user in a state in which the flow cross-sectional area thereof is increased as the gas is flowing in the diffusing case 210.

FIGS. 6 and 7 show a diffusing case 210 in which the inner diameter thereof increases from the rear side 212 to the front side 211 and accordingly an outer diameter thereof increases in the same manner. The gas inlet hole 215 may be defined in the rear side 212 of the diffusing case 210. When the diffusing case 210 is coupled to the main body 110, the gas inlet hole 215 may be positioned to face, surround, or communicate with the gas outlet 150. Further, the gas discharged from the gas outlet 150 may be introduced into the diffusing case 210 through the gas inlet hole 215.

The gas inlet hole 215 may be located at a center of the rear side 212 of the diffusing case 210 when viewed from the rear, and a cross-sectional shape of the gas inlet hole 215 may correspond to that of the gas outlet 150. For example, the gas inlet hole 215 may be defined to have an inner diameter larger than that of the side opening 156 of the gas outlet 150, so that the gas discharged from the gas outlet 150 may be completely introduced into the diffusing case 210 through the gas inlet hole 215.

The second coupling portion 220 coupled to the main body 110 may be provided on the rear side 212 of the diffusing case 210. The diffusing case 210 may include a rear circumferential portion or body 217 surrounding the gas inlet hole 215 in the rear side 212, and the second coupling portion 220 may be provided at a rear end or side of the rear circumferential portion 217 surrounding the gas inlet hole 215.

The second coupling portion 220 may further include a coupling sleeve or flange 224. The coupling sleeve 224 may extend rearward from the rear of the rear circumferential portion 217. The coupling sleeve 224 may be provided to outwardly surround the front end 112 of the main body 110 when the diffuser 200 is coupled to the main body 110.

The first coupling portion 120 may be provided at the front end 112 of the main body 110 and may have a first magnetic fastening portion 127 (e.g., a magnet of a first polarity or a metal) embedded inside the outer wall of the front end 112 or located inside the outer wall. The first coupling portion 120 may further include a power transmitter or transceiver 122 (e.g., a wireless power transceiver that works through electromagnetic induction) provided on an outer surface or a front surface of the outer wall of the front end 112.

The second coupling portion 220 may have a second magnetic fastening portion 227 (e.g., a magnet of a second polarity or a metal) embedded in the rear circumferential portion 217 or located inside the rear circumferential portion 217. The second coupling portion 220 may further include a power receiver or transceiver 222 (e.g., a wireless power transceiver that works through electromagnetic induction) provided on or at an inner surface or rear surface of the coupling sleeve 224. The power transmitter and receiver 122 and 222 will be described in more detail with reference to FIGS. 8-11.

The first coupling portion 120 may be coupled to the second coupling portion 220. At least one of the first magnetic fastening portion 127 and the second magnetic fastening portion 227 may include a magnetic force generator (e.g., a ferromagnetic material or an electric current) so that the first magnetic fastening portion 127 and the second magnetic fastening portion 227 may be magnetically coupled to each other. The magnetic coupling means a scheme of mutual coupling through a magnetic force generated from the magnetic force generator, which may be implemented as a magnet and/or an electromagnet.

The power transmitter 122 may supply power to the power receiver 222, which may be aligned, in contact with, or in connection with the power receiver 222 when the diffuser 200 is coupled to the main body 110. The power receiver 222 may be connected to components or devices of the diffuser 200 (e.g., the light irradiator 260, the proximity sensor 269, and the moisture measurement protrusion 312 described later) to supply power thereto.

The open surface surrounded by the front circumferential portion 236 may be defined in the front side 211 of the diffusing case 210, and the gas inside the diffusing case 210 may be discharged forward through the diffuser 200 through the open surface in the front side 211.

The guide frame 240 may be provided inside the diffusing case 210. The guide frame 240 may guide the flow of the gas introduced through the gas inlet hole 215.

The guide frame 240 may face the gas inlet hole 215 of the diffusing case 210. The guide frame 240 may have a diffusion portion or base 241 at a center thereof, a first guide or ring 246 provided radially outward of the diffusion portion 241, and a second guide or ring 251 provided radially outward of the first guide 246. The guide frame 240 may include a guide connector or tab 253 extending along the radial direction of the diffuser 200 to connect the diffusion portion 241, the first guide 246, and the second guide 251 to each other.

The diffusion portion 241 of the guide frame 240 may face the gas inlet hole 215 to diffuse the gas introduced through the gas inlet hole 215 outward in the radial direction. The flow cross-sectional area of the gas introduced through the gas inlet hole 215 may be increased by the diffusion portion 241.

A flow direction of the gas discharged from the center opening 154 may be changed by the diffusion portion 241. The diffusion portion 241 may have a larger diameter than the center opening 154, and diffuse the gas provided from the center opening 154 outward in the radial direction.

The first guide 246 may have a ring shape, and the diffusion portion 241 may be located at a center of the first guide 246. The diffusion portion 241 may have a circular cross-section, and may be outwardly spaced apart from the diffusion portion 241 while being concentric with the diffusion portion 241 of the first guide 246.

A first flow path or opening 258 may be provided between the first guide 246 and the diffusion portion 241. The first guide 246 may be spaced apart from the diffusion portion 241 to define the first flow path 258 between the first guide 246 and the diffusion portion 241. The gas diffused through the diffusion portion 241 may flow through the first flow path 258.

The second guide 251 may have a ring shape corresponding to the ring shape of the first guide 246, and the diffusion portion 241 and the first guide 246 may be located at a center of the second guide 251. The second guide 251 may be concentric with the diffusion portion 241 and the first guide 246 and may be spaced apart from the first guide 246.

An inner diameter of the first guide 246 may be larger than the diameter of the diffusion portion 241, and an inner diameter of the second guide 251 may be larger than an outer diameter of the first guide 246. Accordingly, the first flow path 258 may be defined between the diffusion portion 241 and the first guide 246, and a second flow path or opening 259 may be defined between the first guide 246 and the second guide 251.

The gas diffused by the diffusion portion 241 may flow through the first flow path 258 and the second flow path 259. An outer diameter of the second flow path 259 may be larger than the diameter of the gas inlet hole 215, so that the gas introduced through the gas inlet hole 215 may be diffused by the diffusion portion 241 and flow with a larger flow cross-section.

The light irradiator 260 may be located in front of the guide frame 240 and installed on a front surface of the guide frame 240. The light irradiator 260 may have a plurality of light emitters 262 (e.g., light emitting diodes or LEDs) arranged on a circuit board 265. The circuit board 265 may include a plurality of circuit boards separated from each other, and the plurality of boards of the circuit board 265 may have a size, shape and arrangement corresponding to that of the diffusion portion 241, the first guide 246, and the second guide 251 of the guide frame 240. The circuit board 265 may not interfere with gas or air flowing through the first and second flow paths 258 and 259.

The plurality of circuit boards 265 may respectively include a central board or base 266, a first board or ring 267, and a second board or ring 268. The central board 266 may have a cross-sectional shape corresponding to the diffusion portion 241. For example, the diffusion portion 241 may have the circular cross-section, and the central board 266 may have a circular cross-section in the same manner as the diffusion portion 241. The central board 266 may be provided on or at a front surface of the diffusion portion 241 and may include a plurality of light emitters 262.

The first board 267 may have a shape corresponding to the first guide 246. For example, the first guide 246 may have a ring shape, and the first board 267 may have a ring shape in the same manner as the first guide 246. The first board 267 be provided on or at a front surface of the first guide 246 and may include a plurality of light emitters 262.

The second board 268 may have a shape corresponding to the second guide 251. For example, the second guide 251 may have a ring shape, and the second board 268 may have a ring shape in the same manner as the second guide 251. The second board 268 may be provided on or at a front surface of the second guide 251 and may include a plurality of light emitters 262.

The central board 266, the first board 267, and the second board 268 may be arranged to be concentric like the diffusion portion 241, first guide 246, and second guide 251 of the guide frame 240. The first board 267 may be outwardly or radially spaced apart from the central board 266, and the second board 268 may be outwardly or radially spaced apart from the first board 267. An inner diameter of the first board 267 may be larger than a diameter of the central board 266, and an inner diameter of the second board 268 may be larger than an outer diameter of the first board 267. Like the guide frame 240, the first flow path 258 may be located between the central board 266 and the first board 267, and the second flow path 259 may be located between the first board 267 and the second board 268.

A position of the light irradiator 260 may be secured by a coupling between the light diffusion frame 280 and the guide frame 240, which will be described later. Alternatively, the central board 266, the first board 267, and the second board 268 may be optionally coupled (e.g., adhered, welded, or pressed-fit) to front surfaces of the diffusion portion 241, the first guide 246, and the second guide 251, respectively. The circuit board 265 may include optional tabs or connectors corresponding to the guide connectors 253 to connect the central board 266, the first board 267, and the second board 268 to each other. When such optional connectors are included, the optional connectors may be coupled to (e.g., adhered, welded, or pressed-fit) to the guide connectors 254 of the guide frame 140 and/or light diffusion connectors 288 of the light diffusion frame 280 described later. As another alternative, when such optional connectors are included, the circuit board 265 may be coupled to just one or two of the front surfaces of the diffusion portion 241, the first guide 246, and the second guide 251. For example, the central board 266 may be secured to the diffusion portion 241, while the first and second boards 267 and 268 merely contact and/or are merely positioned to align with the first guide 246, and the second guide 251, respectively.

The light irradiator 260 may irradiate light toward the front side 211 of the diffusing case 210 through the plurality of light emitters 262. The light irradiated from the light irradiator 260 may be emitted toward a location ahead or forward of the diffuser 200 through the front side 211 of the diffusing case 210.

For example, the light irradiated from the light irradiator 260 may pass through the open surface of the diffusing case 210 and through the gas discharge holes 305 of the discharge cover 300, through the massage protrusion 310 of the discharge cover 300, or, if the discharge cover 300 is made of a transparent or translucent material, through a main body or portion the discharge cover 300.

As the light is irradiated forward from the diffuser 200, the diffuser 200 may treat a user's hair or scalp care. The light irradiated from the light irradiator 260 may contribute to improving scalp and hair health while drying the user's scalp or hair or while providing heat to the user's scalp or hair. The wavelength of the light irradiated from the light emitter 262 may be predetermined or may be selected by the user. For example, red light (620-660 nm) may be used to prevent hair loss or increase blood flow to the scalp, or UV light (100-400 nm) may be used to sanitize the scalp or treat skin conditions such as scalp psoriasis.

The proximity sensor 269 may be provided on the circuit board 265 of the light irradiator 260. FIG. 6 shows a state in which the proximity sensor 269 is provided on the central board 266 of the light irradiator 260.

The proximity sensor 269 may be provided at a center of the central board 266. The proximity sensor 269 may be provided to measure a separation distance from the target positioned in front of the proximity sensor 269. The controller 115 may be provided to control the light irradiator 260 based on the separation distance between the proximity sensor 269 and the target measured by the proximity sensor 269.

For example, when the separation distance from the target measured by the proximity sensor 269 is equal to or less than a reference or predetermined distance, the controller 115 may control the light irradiator 260 such that the light irradiator 260 irradiates the light forward via the light emitters 262. The reference distance may be predetermined in terms of a design or control. The light irradiator 260 may also be operated through a physical switch, which may be operated even when the separation distance measured by the proximity sensor 269 is equal to or less than the reference distance. As the proximity sensor 269 is used, the light irradiator 260 may be operated when the separation distance from the target in front of the diffuser 200 (i.e., the scalp or the hair of the user) is equal to or less than the reference distance, thereby improving ease of use and an operation efficiency.

The proximity sensor 269 may be provided in various types. For example, the proximity sensor 269 may be a pressure sensor that detects whether a pressing force is applied from the user's scalp or hair, or a photosensitive sensor that measures a level at which an amount of sensed light decreases as the separation distance from the scalp or the hair decreases.

In addition, the proximity sensor 269 may be an infrared (IR) sensor that measures an infrared ray transmitted from the target to measure the separation distance from the scalp or the hair. In this case, the proximity sensor 269 may be provided to irradiate the infrared ray forward.

The light diffusion frame 280 may be located in front of the light irradiator 260. The light diffusion frame 280 may be installed on a front surface of the light irradiator 260 to forwardly cover the light emitters 262 of the light irradiator 260.

The light diffusion frame 280 may include a central light diffusion portion or diffuser 282, a first light diffusion portion or diffuser 284 and a second light diffusion portion or diffuser 286. The light diffusion frame 280 may further include a light diffusion connector 288 to connect the central light diffusion portion 282, the first light diffusion portion 284, and the second light diffusion portion 286 to each other.

The central light diffusion portion 282 may have a cross-sectional shape corresponding to that of the central board 266. For example, the central board 266 may have a circular cross-section, and the central light diffusion portion 282 may have a circular cross-section in the same manner as the central board 266 and may cover the front surface of the diffusion portion 241.

The first light diffusion portion 284 may have a shape corresponding to the first board 267. For example, the first board 267 may have the previously described ring shape, and the first light diffusion portion 284 may have a ring shape in the same manner as the first board 267 and may cover the front surface of the first board 267.

The second light diffusion portion 286 may have a shape corresponding to the second board 268. For example, the second board 268 may have the previously described ring shape, and the second light diffusion portion 286 may have a ring shape in the same manner as the second board 268 and may cover the front surface of the second board 268.

The central light diffusion portion 282, the first light diffusion portion 284, and the second light diffusion portion 286 may be arranged to be concentric like the arrangement of the guide frame 240 and the light irradiator 260. The first light diffusion portion 284 may be outwardly spaced apart from the central light diffusion portion 282, and the second light diffusion portion 286 may be outwardly spaced apart from the first light diffusion portion 284 so as not to block a flow of discharged air or gas.

An inner diameter of the first light diffusion portion 284 may be larger than a diameter of the central light diffusion portion 282, and an inner diameter of the second light diffusion portion 286 may be larger than an outer diameter of the first light diffusion portion 284. Like the guide frame 240, the first flow path 258 may be located between the central light diffusion portion 282 and the first light diffusion portion 284, and the second flow path 259 may be located between the first light diffusion portion 284 and the second light diffusion portion 286.

The diffuser 200 may be provided in a shape in which the first flow path 258 and the second flow path 259 are extended in the front and rear directions through the guide frame 240, the light irradiator 260, and the light diffusion frame 280. The light diffusion connector 288 may be provided in a shape corresponding to the guide connector 253. For example, the guide connector 253 and the light diffusion connector 288 may have an extended shape along the radial direction of the diffuser 200.

The light diffusion connector 288 may be located in front of and aligned with the guide connector 253 so as not to block a flow of discharged air or gas. The light diffusion frame 280 may be fixed inside the diffusing case 210 as the light diffusion frame 280 is fastened to the guide connector 253.

An embodiment of the present disclosure is advantageous in terms of a design and structurally stable in that, in a state in which the guide frame 240 is constituted by a plurality of components, the plurality of components may be able to be handled as a single component through the guide connector 253. In addition, an embodiment of the present disclosure is advantageous in terms of the design and structurally stability in that, in a state in which the light diffusion frame 280 is constituted by a plurality of components, the plurality of components are able to be handled as a single component through the light diffusion connector 288.

Furthermore, the light diffusion connector 288 of the light diffusion frame 280 may be coupled to the guide connector 253 of the guide frame 240, so that all of the central light diffusion portion 282, the first light diffusion portion 284, and the second light diffusion portion 286 may be stably fixed and secure, which is advantageous in terms of coupling.

The light diffusion frame 280 may be made of a material through which light is transmitted (i.e., a transparent or translucent material, such as plastic or glass). The light irradiated from the light irradiator 260 may be scattered and diffused while passing through the light diffusion frame 280. The light diffusion frame 280 may be provided in front of the light irradiator 260 so that the light irradiated from the light irradiator 260 may be provided to the user while being scattered and diffused and being uniformly dispersed in a larger area.

A treatment for the diffusion or the scattering of the light may be performed on a front surface or a rear surface of the light diffusion frame 280. For example, etching may be performed or a pattern through laser processing and the like may be formed on a surface of the light diffusion frame 280.

In one example, the central light diffusion portion 282 may shield the front surface of the central board 266, and a portion of the central light diffusion portion 282 in front of the proximity sensor 269 may be opened or formed with a hole such that the measurement of the separation distance from the target in front of the diffuser 200 via the proximity sensor 269 may be convenient or undisturbed. When the proximity sensor 269 is provided at the center of the central board 266, the central light diffusion portion 282 may have a hole defined at a center thereof (as shown in the figures) to expose the proximity sensor 269 forwardly and allow transmission of a signal to or from the proximity sensor 269.

The discharge cover 300 may shield the open surface defined in the front side 211 of the diffusing case 210 in which the guide frame 240, the light irradiator 260, and the light diffusion frame 280 may be embedded. The plurality of gas discharge holes 305 may be defined in the discharge cover 300 so that gas may be discharged and the light may be irradiated forward.

The edge 302 of the discharge cover 300 may have a curvature configured to correspond to that of the front circumferential portion 236 of the diffusing case 210 when viewed from the side. A front surface of the discharge cover 300 may form a curved surface that is indented or recessed rearwards centerwardly so that the discharge cover 300 may have a shape corresponding to the head of the user, which may facilitate a massage effect through the massage protrusions 310 while providing the gas or air and the light to the user.

The plurality of massage protrusions 310 may each have a contact portion provided on a front surface or end thereof. The contact portions of the plurality of massage protrusions 310 may be configured such that a sense of touch with the scalp or the hair of the user may be improved and damage to the scalp and the hair may be minimized. For example, the contact portion may be made of an elastic or soft material such as silicon, rubber, or plastic.

The discharge cover 300 may also include at least one moisture measurement protrusion or sensor 312, which may also serve as a massage protrusion 310. The moisture measurement protrusion 312 may be provided to measure a moisture amount of the scalp or the hair of the user. A pair of moisture measurement protrusions 312 may be arranged to measure an impedance, such as a bioelectrical impedance through an electric field formed therebetween.

The moisture measurement protrusions 312 may be connected to the controller 115. The controller 115 may determine the impedance using a voltage, a current, a resistance, and the like, which are identified through the moisture measurement protrusion 312, and determine the moisture amount of the scalp or the hair of the user based on the determined impedance. The controller 115 may further control an operation of the fan 119, the temperature adjuster 117, or the light irradiator 260 based on the determined moisture amount.

For example, the controller 115 may control the fan 119 to increase a rotation speed (such that the speed of discharged gas increases) as the determined moisture amount of the scalp or the hair of the user increases. Alternatively or in addition thereto, the controller 115 may control the temperature adjuster 117 such that a temperature of the discharged gas increases and/or control the light irradiator 260 such that a light amount or intensity increases as the determined moisture amount of the scalp or the hair of the user increases. A light amount or intensity may be increased by increasing a number of light emitters 262 emitting light and/or increasing an intensity of light emitted by each light emitter 262.

A pair of moisture measurement protrusions 312 may include a first moisture measurement protrusion 315 electrically having a first pole and a second moisture measurement protrusion 316 having a second pole opposite to the first pole. The controller 115 may determine the impedance and the moisture amount through the electric field formed between the first moisture measurement protrusion 315 and the second moisture measurement protrusion 316.

A plurality of pairs of moisture measurement protrusions 312, each of which includes the first moisture measurement protrusion 315 and the second moisture measurement protrusion 316, may be arranged. One pair of moisture measurement protrusions 312 may be provided to be spaced apart from another pair of moisture measurement protrusions 312, and different massage protrusions 310 may be positioned therebetween.

In one example, the open region 303 may be defined at a center of the discharge cover 300. The proximity sensor 269 may be exposed forward through the hole defined in the light diffusion frame 280 and the open region 303 of the discharge cover 300, and may measure the separation distance from the target in front of the diffuser 200. A protection member (e.g., a transparent film or layer) that protects the proximity sensor 269 and allows the infrared ray or the like to pass straight therethrough may be provided in front of the proximity sensor 269 (e.g., in a center hole of the light diffusion frame or in the open region 303).

Referring to FIG. 7, the first coupling portion 120 of the main body 110 may include the first magnetic fastening portion 127, and the second coupling portion 220 of the diffuser 200 may include the second magnetic fastening portion 227. The diffuser 200 may be coupled to the front end 112 of the main body 110 through a magnetic coupling or interaction between the first magnetic fastening portion 127 and the second magnetic fastening portion 227. The first coupling portion 120 may further include a hook fastener or loop, and the second coupling portion 220 may further include a hook configured to be fastened to the hook fastener so that a coupling stability between the diffuser 200 and the main body 110 may be enhanced.

Hereinafter, a flow of the gas discharged from the gas outlet 150 according to an embodiment of the present disclosure will be described with reference to FIG. 7. In the gas outlet 150, the gas is discharged from the center opening 154 and the side opening 156. The gas inlet hole 215 of the diffusing case 210 may have a diameter equal to or larger than that of the side opening 156 and face the gas outlet 150 so that the gas discharged from the center opening 154 and the side opening 156 may be introduced into the inlet hole 215.

The guide frame 240 may be provided inside the diffusing case 210 to face the gas outlet 150. The diffusion portion 241 of the guide frame 240 may be positioned to face the center opening 154 of the gas outlet 150.

The gas discharged from the center opening 154 may flow toward the diffusion portion 241. As the diffusion portion 241 has a diameter larger than that of the center opening 154, the gas discharged from the center opening 154 may be diffused outward along the radial direction of the diffuser 200.

The diffusion portion 241 may have a diffusion protrusion or cone 242 on a rear surface thereof facing the center opening 154. The diffusion protrusion 242 may have a curvature such that a diameter thereof decreases in a rearward direction to protrude or point toward the gas outlet 160. The diameter of the diffusion protrusion 242 may decrease toward a center, which may face the gas outlet 160. A diffusion effect of the gas discharged from the center opening 154 may be improved by the diffusion protrusion 242.

At least a portion of the gas discharged from the center opening 154 may flow along the first flow path 258 defined between the diffusion portion 241 and the first guide 246 in the guide frame 240 by the diffusion portion 241 and the diffusion protrusion 242. In one example, the gas discharged from the side opening 156 may flow outward to surround the gas discharged from the center opening 154, and the gas discharged from the side opening 156 may also diffuse outward along the radial direction of the diffuser 200 as the gas of the center opening 154 is diffused by the diffusion portion 241. At least a portion of the gas discharged from the side opening 156 and at least a portion of the gas discharged from the center opening 154 may flow along the second flow path 259 defined between the first guide 246 and the second guide 251 in the guide frame 240.

Despite a design feature where the inner diameter of the diffuser 200 may increase in a forward direction, the discharging of the gas through the center opening 154 and the side opening 156 in the forward direction while being maintained in a specific form may be effectively suppressed through the guide frame 240. The diffuser 200 may allow the gas discharged from the center opening 154 and the side opening 156 to be effectively dispersed and diffused with a larger flow cross-sectional area while preventing the flow of the gas from being maintained in the specific form.

In one example, the light irradiator 260 and the light diffusion frame 280 may be arranged in front of the guide frame 240 inside the diffusing case 210. The light irradiator 260 and the light diffusion frame 280 may be coupled with the guide frame 240 and may be handled as a single component, improving space utilization, convenience, security, and design.

The light irradiator 260 and the light diffusion frame 280 may define the first flow path 258 and the second flow path 259 together with the guide frame 240. The flow of the gas formed by the guide frame 240 may be effectively maintained, and the gas may be discharged forward from the diffuser 200 through the light irradiator 260 and the light diffusion frame 280.

In the light irradiator 260, the first board 267 may be positioned to be forward or in front of of the central board 266, and the second board 268 may be positioned to be forward or in front of the first board 267. The plurality of light emitters 262 arranged in the light irradiator 260 may be arranged to form a spherical or curved surface that is indented or recessed rearward. The plurality of light emitters 262 may be arranged in a form in which a distance from a center of the light irradiator 260 along the radial direction increases forwardly. Such arrangement of the light emitters 262 may correspond to the shape of the front surface of the discharge cover 300 indented rearward. The plurality of light emitters 262 arranged on the light irradiator 260 may be arranged to form the curved surface to correspond to the user's head having a curvature, so that a uniform amount of light may be provided to the user's scalp and hair.

Like the light irradiator 260, the guide frame 240 may be provided such that the first guide 246 may be positioned forward or in front of the diffusion portion 241, and the second guide 251 may be positioned forward or in front of the first guide 246. The first board 267 provided on the front surface of the first guide 246 may be positioned forward or in front of the central board 266 provided at the front surface of the diffusion portion 241, and the second board 268 provided at the front surface of the second guide 251 may be positioned forward or in front of the first board 267.

Like the light irradiator 260, in the light diffusion frame 280, the first light diffusion portion 284 may be positioned forward or in front of the central light diffusion portion 282, and the second light diffusion portion 286 may be positioned forward or in front of the first light diffusion portion 284. A distance between the light diffusion frame 280 and the light irradiator 260 may be kept constant, and uniform dispersion and scattering of the light may be induced. In the guide frame 240, as the second guide 251 may be positioned forward of the first guide 246 and the first guide 246 may be positioned forward of the diffusion portion 241, a space in which the gas introduced from the gas inlet hole 215 is diffused in the radial direction may be secured, and the gas may be smoothly introduced into the first flow path 258 and the second flow path 259.

FIG. 7 shows the guide frame 240, the light irradiator 260, and the light diffusion frame 280 protruding forward in a direction away from centers thereof.

FIG. 7 also shows a light blocking portion or shield 271 surrounding the proximity sensor 269. The light blocking portion 271 may have a hollow cylindrical shape, but embodiments disclosed herein are not limited. The light blocking portion 271 may be provided to surround the proximity sensor 269 along a circumferential direction of the diffuser 200, preventing a situation in which the light emitter 262 around the proximity sensor 269 affects a measurement the proximity sensor 269. The proximity sensor 269 may be located inside the light blocking portion 271. The light blocking portion 271 may have a shape extending from the central board 266 to the discharge cover 300.

The light blocking portion 271 may be opened in a forward direction to prevent structural interference from occurring in a measurement of the separation distance between the diffuser 200 and the front target by the proximity sensor 269. For example, when the proximity sensor 269 measures an infrared ray transmitted from the target, the light blocking portion 271 may have a front opening to allow the infrared ray transmitted from the target to be completely provided to the proximity sensor 269.

The light blocking portion 271 may be provided to extend rearward from the discharge cover 300, or may be formed integrally with the discharge cover 300 or integrally with the central board 266. The light blocking portion 271 may be manufactured separately from the discharge cover 300 and the central board 266, and may be later coupled to or combined with the discharge cover 300 and/or the central board 266.

Figure 8:
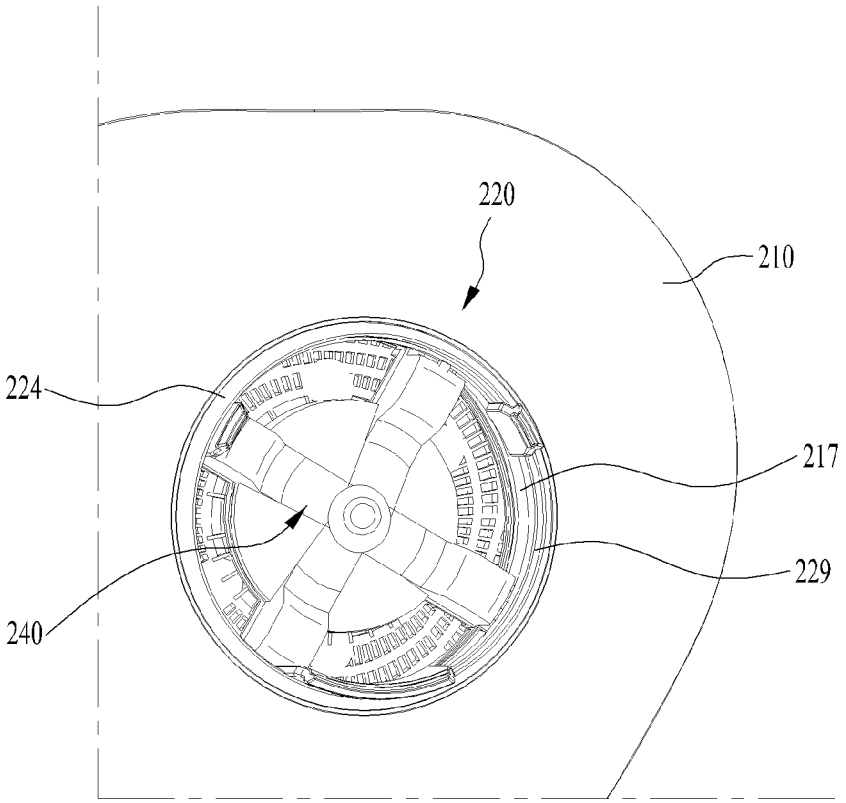
FIG. 8 is a view showing a second coupling portion of a diffuser according to an embodiment.
Figure 9:
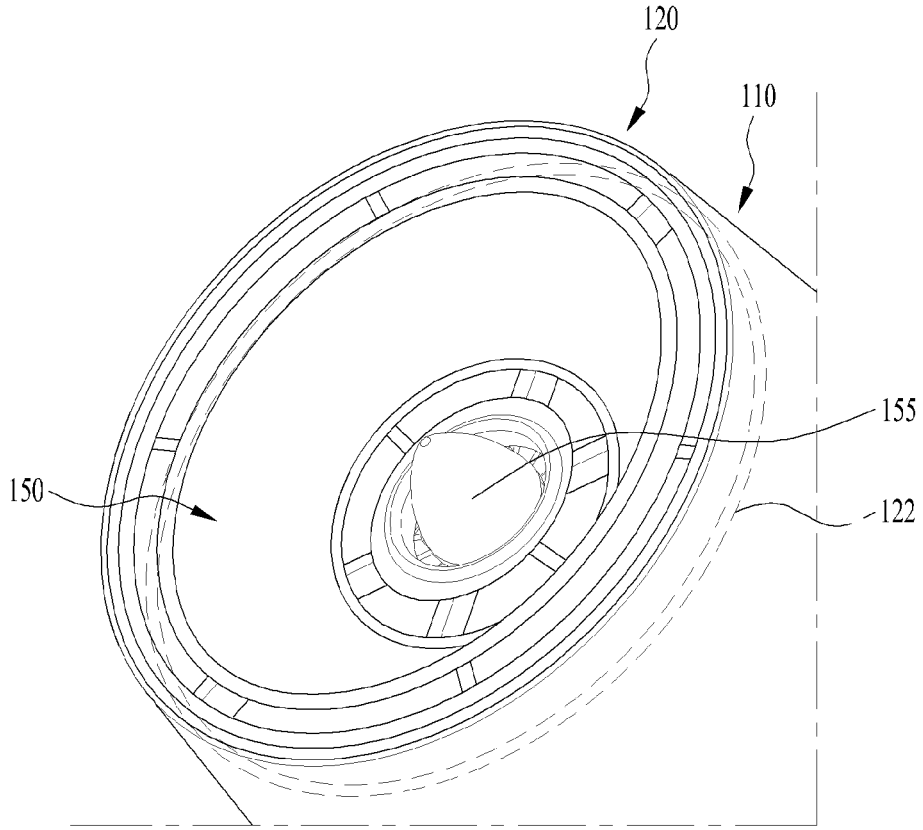
FIG. 9 is a view showing a first coupling portion provided on a main body of a hair dryer according to an embodiment.

Referring to FIGS. 8 and 9, in the hair dryer 100 according to an embodiment, the main body 110 may be provided such that the front end 112 of the outer wall surrounds the gas outlet 150. The first coupling portion 120 to which the diffuser 200 is coupled may be provided at the front end 112. The diffusing case 210 may have the second coupling portion 220 that is coupled to the first coupling portion 120 while surrounding the gas inlet hole 215 on the rear side 212.

The first coupling portion 120 may include a wireless power transmitter 122 provided to wirelessly supply power to the diffuser 200. The second coupling portion 220 may include a wireless power receiver 222 that wirelessly receives the power from the wireless power transmitter 122.

The first coupling portion 120 provided at the front end 112 of the main body 110 may be coupled to the second coupling portion 220 provided on the rear side 212 of the diffusing case 210. A coupling scheme of the first coupling portion 120 and the second coupling portion 220 may be various. FIG. 8 shows a state in which the second magnetic fastening portion 227 (FIG. 7) may be provided on an inner surface of the coupling sleeve 224 according to an embodiment.

For example, the first coupling portion 120 and the second coupling portion 220 may be coupled to each other in various schemes, such as magnetic coupling using the magnetic force generator, hook coupling, sliding coupling, screw coupling, and the like. U.S. application Ser. No. 17/077,929 filed on Oct. 22, 2020 provides details on some of the possible implementations of the first and second coupling portions 120 and 220, the entire contents of which are incorporated by reference herein.

As the first coupling portion 120 may be provided at the front end 112 of the main body 110 and the second coupling portion 220 may be provided on the rear side 212 of the diffusing case 210, the rear side of the diffuser 200 may be coupled to the front end 112 of the main body 110 so that the gas may be discharged from the gas outlet 150 to the gas inlet hole 215.

Because the first coupling portion 120 may be provided to surround the gas outlet 150 and the second coupling portion 220 may be provided to surround the gas inlet hole 215, when the first coupling portion 120 and the second coupling portion 220 may be coupled to each other, the gas discharged from the gas outlet 150 may be introduced into the diffuser 200 through the gas inlet hole 215 while leakage or escape of the gas to the outside may be minimized.

The wireless power transmitter 122 and the wireless power receiver 222 may respectively include magnetic induction coils, and may transmit and receive the power with each other in a mutual magnetic induction scheme. Therefore, a physical contact between the wireless power transmitter 122 and the wireless power receiver 222 may be not necessarily required in the connection between the wireless power transmitter 122 and the wireless power receiver 222. As an alternative implementation, the power transmitter and receiver 122 and 222 may include terminals and/or electrodes such that contact may be required to secure an electrical connection.

The wireless power transmitter 122 may be provided at various locations, for example, a location on an inner surface or an outer surface of the front end 112 of the main body 110, a location inside the outer wall of the front end 112, etc. FIG. 9 shows a state in which the wireless power transmitter 122 may be embedded inside the front end 112 of the outer wall of the main body 110 according to an embodiment.

The wireless power transmitter 122 may be formed in various shapes. FIG. 9 schematically shows the wireless power transmitter 122 having a ring shape surrounding the gas outlet 150 according to an embodiment.

The wireless power receiver 222 may be provided at various locations, for example, a location inward, rearward, or forward of the rear circumferential portion 217 in the diffusing case 210, a location on the inner surface or the outer surface of the coupling sleeve 224, a location inside the rear circumferential portion 217 or the coupling sleeve 224, etc.

The wireless power receiver 222 may be formed in various shapes, and may be formed in a shape corresponding to the wireless power transmitter 122. For example, when the wireless power transmitter 122 may be formed in a ring shape as shown in FIG. 9, the wireless power receiver 222 may also be formed in the ring shape to exchange the power with the wireless power transmitter 122.

As the wireless power transmitter 122 may be provided at the first coupling portion 120 of the main body 110 and the wireless power receiver 222 may be provided at the second coupling portion 220 of the diffuser 200, a separate coupling structure or a coupling process for the power transmission may be omitted in the coupling of the diffuser 200 and the main body 110, thereby improving ease of use and a structural advantage.

Embodiments disclosed herein may supply power wirelessly through the wireless power transmitter 122 and the wireless power receiver 222 so that physical contact between the wireless power transmitter 122 and the wireless power receiver 222 may be not required, which may be advantageous because design freedom may be increased. Connection stability for the power transmission and reception may be improved, and convenience for the coupling of the diffuser 200 and the main body 110 may be provided to the user.

Figure 10:
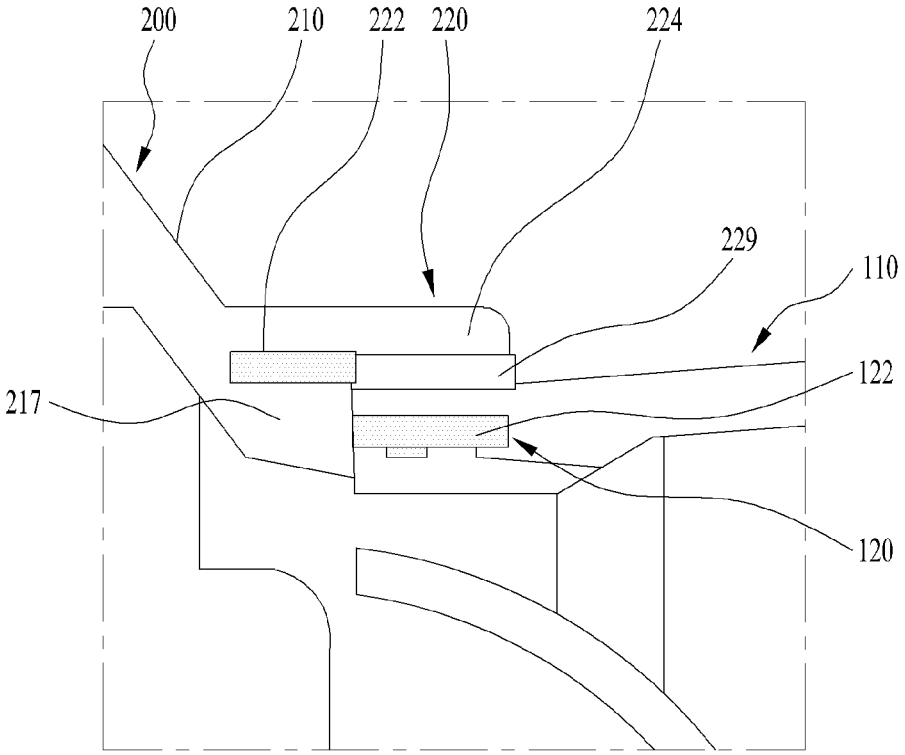
FIG. 10 is a view showing a state in which a first coupling portion and a second coupling portion are coupled to each other in a hair dryer according to an embodiment.

In one example, FIG. 10 shows a state in which the diffuser 200 and the main body 110 are coupled to each other so that the wireless power transmitter 122 and the wireless power receiver 222 may be electrically coupled to each other. Referring to FIG. 10, the wireless power transmitter 122 may be embedded in the outer wall of the main body 110, so that the power may be supplied to the wireless power receiver 222 in the state in which the first coupling portion 120 and the second coupling portion 220 are coupled. As previously described, physical contact between the wireless power transmitter 122 and the wireless power receiver 222 may be not required.

The wireless power transmitter 122 may be embedded in the outer wall located at the front end 112 of the main body 110. A space occupied by the wireless power transmitter 122 may be reduced or not be visible when the first coupling portion 120 is provided at the front end 112 of the main body 110, which may be advantageous in design.

The wireless power transmitter 122 may be provided such that one of a front surface, an outer surface, an inner surface, and/or a rear surface thereof may be exposed to an outside from the outer wall of the main body 110 as needed. FIG. 10 shows a state in which the front surface of the wireless power transmitter 122 may be provided to be forwardly exposed from the front end 112 of the main body 110 according to an embodiment.

The diffusing case 210 may include the rear circumferential portion 217 surrounding the gas inlet hole 215 at the rear side 212. The wireless power receiver 222 may be embedded in the rear circumferential portion 217 to receive the power from the wireless power transmitter 122. FIG. 10 shows a state in which the wireless power receiver 222 is embedded in the rear circumferential portion 217 surrounding the gas inlet hole 215 according to an embodiment. Accordingly, the wireless power receiver 222 may not occupy a separate space in the second coupling portion 220 of the diffuser 200, which may be advantageous in design.

As the wireless power transmitter 122 may be embedded in the front end 112 of the outer wall of the main body 110 surrounding the gas outlet 150, the wireless power receiver 222 embedded in the rear circumferential portion 217 may have a shape corresponding to the wireless power transmitter 122 and may be located adjacent to the wireless power transmitter 122 when the diffuser 200 and the main body 110 are coupled. Such a design may provide an advantageous connection between the wireless power transmitter 122 and the wireless power receiver 222.

The wireless power receiver 222 may be provided such that one of a rear surface, an inner surface, or an outer surface thereof may be exposed to the outside from the rear circumferential portion 217 as needed. As portions of the wireless power transmitter 122 and the wireless power receiver 222 may be exposed to the outside, minimum design volumes of the front end 112 of the main body 110 and the rear circumferential portion 217 into which the wireless power transmitter 122 or the wireless power receiver 222 may be respectively embedded may be reduced.

Figure 11:
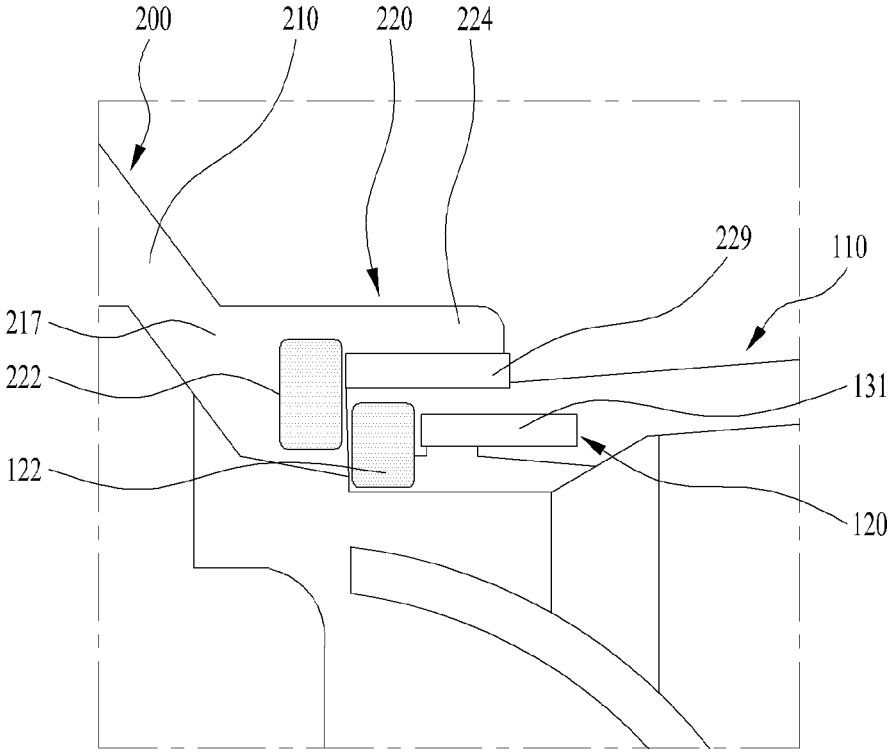
FIG. 11 is a view showing a state in which a second coupling portion including a first magnetic force generator is coupled to a first coupling portion including a second magnetic force generator in an embodiment.

FIG. 10 shows a state in which the rear surface of the wireless power receiver 222 may be exposed rearward from the rear circumferential portion 217 according to an embodiment. In one example, the coupling sleeve 224 may extend rearward from the rear circumferential portion 217 so that an inner surface of the coupling sleeve 224 surrounds the outer surface of the front end 112 of the main body 110. The front end 112 of the main body 110 may have the first magnetic fastening portion 127 (FIG. 7), which may include a first magnetic force generator 131. The coupling sleeve 224 may have the second magnetic fastening portion 227 (FIG. 7), which include a second magnetic force generator 229 configured to be coupled to the first magnetic force generator 131 (FIG. 11).

Referring to FIGS. 8-11, the first magnetic force generator 131 may generate a magnetic force, and may be a magnet, an electromagnet, etc. The first magnetic force generator 131 may be coupled to the front end 112 of the main body 11. The first magnetic force generator 131 may generate an attractive force at the wireless power receiver 222 or may generate an attractive force at the front end 112 of the main body 110 containing a magnetic substance. The first magnetic force generator 131 may include a magnetic or magnetized substance, such as a metal, which is a substance that may be magnetized in a magnetic field.

An embodiment of the present disclosure adopts the wireless power transmission and reception scheme, so that a specific directionality for the coupling of the diffuser 200 in the circumferential direction of the diffuser 200 may be eliminated. In order to remove such directionality, an embodiment of the present disclosure may allow the specific directionality as described above to be eliminated also in structural coupling as the diffuser 200 and the main body 110 may be coupled to each other through the magnetic coupling through the first magnetic force generator 131.

The first magnetic force generator 131 may be formed in a ring shape to be provided on the inner surface of the front end 112. When the diffuser 200 and the main body 110 may be coupled to each other, the first magnetic force generator 131 may be surrounded by the coupling sleeve 224, which may have the second magnetic force generator 229. Referring to FIG. 11, the first magnetic force generator 131 may be located rearward of at least a portion of the wireless power receiver 222 and may be located radially outward of the wireless power transmitter 122.

The wireless power receiver 222 may be embedded inside the rear circumferential portion 217 facing the front end 112 of the main body 110 in the front and rear direction, and the wireless power transmitter 122 may be embedded in the front end 112 of the main body 110, so that the wireless power transmitter 122 and the wireless power receiver 222 may be connected to each other.

The second magnetic force generator 229 may be located on the inner surface of the coupling sleeve 224 to surround the outer surface of the front end 112 of the main body 110 rather than to face the front end 112 of the main body 110. Accordingly, the second magnetic force generator 222 may be magnetically coupled with the front end 112 of the main body 110 while not interrupting the wireless connection between the wireless power transmitter 122 and the wireless power receiver 222. Not only may the magnetic coupling between the second magnetic force generator 229 and the main body 110 be secured, but also a structural coupling in which the second magnetic force generator 229 surrounds the front end 112 of the main body 110 may be performed for further security.

The front end 112 of the main body 110 contains a magnetic substance, and may be magnetically coupled to the second magnetic force generator 229 by the magnetic substance. The magnetic substance may be part of the first magnetic force generator 131, or alternatively be a metal configured to be attracted to the second magnetic force generator 229. As another alternative, an entirety of the front end 122 may be made of a magnetic substance. The second magnetic force generator 229 may generate an attractive force that attracts the magnetic substance contained in the first coupling portion 120, so that coupling between the diffuser 200 and the main body 110 may be achieved.

In one example, FIG. 11 shows that the first magnetic force generator 131 may be provided on the main body 110 in an embodiment, and the second magnetic force generator 229 may be provided on the coupling sleeve 224.

Referring to FIG. 11, the front end 112 of the main body 110 may include the first magnetic force generator 131. The second coupling portion 220 may be magnetically coupled to the first coupling portion 120 by the attraction force between the first magnetic force generator 131 and the second magnetic force generator 229.

An embodiment of the present disclosure may effectively improve the coupling force between the first portion 120 of the main body 110 and the second coupling portion 220 of the diffuser 200 by provided the second magnetic force generator 229 in the diffuser 200 and by disposing the first magnetic force generator 131 in the main body 110. The first magnetic force generator 131 and the second magnetic force generator 229 may be arranged to generate mutual attraction.

The first magnetic force generator 131 may include a plurality second magnetic force generators spaced apart from each other at the front end 112 of the main body 110, or may have a ring shape and be provided on the inner surface, the outer surface, or the front surface of the main body 110. In one example, referring to FIG. 11, in an embodiment of the present disclosure, the first magnetic force generator 131 may be embedded in the front end 112 of the main body 110.

A space occupied separately by the first magnetic force generator 131 may disappear or not be visible, which may be advantageous in design like the wireless power transmitter 122. Strong or secure fixing of the second magnetic force generator 229 may be performed while a separate fixing structure or coupling structure may be omitted.

The first magnetic force generator 131 may be located radially outside of wireless power transmitter 122 within the front end 112. The second magnetic force generator 229 may be provided forward (closer to the diffuser case 200) (or alternatively forward) of the wireless power transmitter 122 within the coupling sleeve 224 and readially outward from the wireless power receiver 222.

The first magnetic force generator 131 embedded in the front end 112 of the main body 110 may be located radially outward (or alternatively, forward or rearward) of the wireless power transmitter 122 embedded together in the front end 112 of the main body 110. The second magnetic force generator 229 may be located between the wireless power transmitter 122 and the wireless power receiver 222, so that the wireless power transmission and reception may not be disturbed.

The first coupling portion 120 may include the first magnetic fastening portion 127 and the first magnetic fastening portion 127 may include the first magnetic force generator 131. The second coupling portion 220 may include the second magnetic fastening portion 227 and the second magnetic fastening portion 227 may include the second magnetic force generator 229.

The second magnetic force generator 229 may be provided such that at least a portion thereof overlaps the first magnetic force generator 131 along the radial direction of the gas outlet 150. As the second magnetic force generator 229, which may be located rearward of the wireless power transmitter 122, may be provided to overlap the first magnetic force generator 131 along the radial direction of the gas outlet 150, the magnetic coupling force between the first magnetic force generator 131 and the second magnetic force generator 229 may be secured.

For the overlapping structure as described above, a length in the front and rear direction or a location of the first magnetic fastening portion may be adjusted, and a location and a length of the second magnetic fastening portion may be similarly adjusted.

Through the above structure, in an embodiment of the present disclosure, a stable connection between the wireless power transmitter 122 and the wireless power receiver 222 may be established, and at the same time, the magnetic coupling between the first magnetic force generator 131 and the second magnetic force generator 229 may be effectively established, so that the effective coupling between the diffuser 200 and the main body 110 may be implemented.

At least one of the first or second magnetic force generators 131 or 229 may be omitted and replaced with a metal or other material. For example, FIG. 10 exemplifies a situation where the first magnetic force generator 131 is omitted, and the second magnetic force generator 229 generates a magnet force configured to attract a front end 112 of the main body 110. The front end 112 of the main body may be made of a ferrous metal (e.g., an iron alloy). Alternatively or in addition thereto, the coils in the wireless power transmitter 122 may generate an electromagnetic force or field configured to be attracted to the second magnetic force generator 131.

Referring to FIGS. 6 and 8-11, the diffuser 200 according to an embodiment of the present disclosure may include the light irradiator 260. The light irradiator 260 may be electrically connected to the wireless power receiver 222 to receive the power from the wireless power receiver 222.

In the light irradiator 260, the plurality of light emitters 262 emit the light while consuming the power. The power consumed by such light emitters 262 may be supplied by the wireless power receiver 222. The main body 110 may be connected to an external power source to receive the power, the diffuser 200 may receive the power from the main body 110 in the wireless power transmission and reception scheme, and the light irradiator 260 may receive the power from the wireless power receiver 222, so that the light emitter 262 may emit the light.

Embodiments disclosed herein may effectively utilize a power consuming device such as the light irradiator 260, etc. because the power may be stably supplied to the diffuser 200 while the separate coupling structure or coupling process for the power connection may be omitted. In one example, the controller 115 may control the light irradiator 260 to irradiate the light when the separation distance from the target measured by the proximity sensor 269 provided on the light irradiator 260 may be equal to or less than the reference distance. Accordingly, embodiments disclosed herein may effectively identify the situation in which the light needs to be irradiated to the user and operate the light irradiator 260 even when there may be no user's separate manipulation, so that the ease of use may be provided, effective power consumption may be possible, and an advantage in durability of the light irradiator 260 may be provided.

In addition, the wireless power receiver 222 may be electrically connected to the proximity sensor 269 to transmit the measured value of the proximity sensor 269 to the wireless power transmitter 122. Further, the controller 115 may be provided on the main body 110 and may receive the measured value of the proximity sensor 269 through the wireless power transmitter 122.

The proximity sensor 269 may generate an electrical signal from the measured separation distance from the front target, for example, the user's scalp or hair. For example, the voltage value or the current value through the proximity sensor 269 may be changed based on the change in the value measured by the proximity sensor 269 to generate the electrical signal.

Such proximity sensor 269 may be connected to the wireless power receiver 222, and the electrical signal of the proximity sensor 269 may be transmitted to the wireless power receiver 222. The electrical signal transmitted to the wireless power receiver 222 may also be transmitted to the wireless power transmitter 122 wirelessly connected to the wireless power receiver 222.

In an embodiment, the controller 115 may be provided on the main body 110, and the controller 115 may be electrically connected to the wireless power transmitter 122. An electrical signal of the proximity sensor 269 transmitted to the wireless power transmitter 122 may be transmitted to the controller 115, and the controller 115 may control the light irradiator 260 based on the electrical signal.

Consequently, not only the transmission and the reception of the power, but also the transmission and the reception of the electric signal may be possible even when the wired connection between diffuser 200 and main body 110 may be omitted. Accordingly, the controller 115 may efficiently operate the light irradiator 260 based on the measured value of the proximity sensor 269, thereby improving the ease of use and the efficiency.

This application is related to co-pending U.S. application Ser. Nos. 17/077,915 filed on Oct. 22, 2020, 17/077,917 filed on Oct. 22, 2020, 17/077,921 filed on Oct. 22, 2020, 17/077,922 filed on Oct. 22, 2020, 17/077,927 filed on Oct. 22, 2020, 17/077,929 filed on Oct. 22, 2020, 17/085,385 filed on Oct. 30 2020, and 17/077,119 filed on Oct. 22, 2020, the entire contents of which are incorporated by reference herein.

Embodiments disclosed herein may provide a hair dryer capable of effectively supplying power to a diffuser through coupling between the diffuser and a main body. Embodiments disclosed herein may provide a hair dryer having a coupling structure in which a diffuser may be stably coupled to and effectively separated from a main body. Embodiments disclosed herein may provide a hair dryer in which a diffuser capable of performing scalp care may be removably provided. The diffuser may include a massage protrusion and a LED module for the scalp care.

Embodiments disclosed herein may provide a hair dryer in which wireless power transmission may be achieved from a main body of the hair dryer to the diffuser for use of the LED module that irradiates light to a user. The LED module may be provided to irradiate the light to the user to care for scalp and hair, and power supply may be required for operation of the LED module.

Embodiments disclosed herein may provide a wireless power transmission/reception structure for transmitting the power to the diffuser, so that a need for coupling the diffuser to the main body in a specific direction or angle may disappear and user convenience may be improved. The diffuser may include a wireless coil capable of wirelessly receiving the power, and the main body may include a wireless coil capable of supplying the power to the diffuser. The wireless coil unit may supply the power wirelessly without directionality, thereby improving ease of use in coupling and separation of the diffuser.

In one example, the diffuser may include a proximity sensor capable of measuring a separation distance from the user, and a measured value of the proximity sensor may be transmitted to the controller provided on the main body using a wireless signal transmission scheme through the wireless coil unit.

Embodiments disclosed herein may be implemented as a hair dryer including a main body, a handle, and a diffuser. The main body may include a gas outlet to discharge fluid (e.g., air, gas) therethrough. The handle may extend from the main body. The diffuser may be removably coupled to the main body to introduce the gas discharged from the gas outlet therein and discharge the gas introduced therein to outside.

The diffuser may include a diffusing case. The diffusing case may have a rear side removably coupled to the main body. The gas discharged from the gas outlet may be introduced into the diffusing case through a gas inlet hole defined at the rear side. The gas introduced into the diffusing case may be discharged from a front side of the diffusing case.

A front end of an outer wall may surround the gas outlet. A first coupling portion coupled with the diffuser may be provided at the front end. The diffusing case may include a second coupling portion coupled to the first coupling portion while surrounding the gas inlet hole defined at the rear side.

The first coupling portion may include a wireless power transmitter to wirelessly supply power to the diffuser. The second coupling portion may include a wireless power receiver to wirelessly receive the power from the wireless power transmitter.

As described above, the wireless power transmitter and the wireless power receiver may be respectively arranged in the first coupling portion and the second coupling portion so that separate fastening for power connection may not be required, and a request of a specific pose or a specific location of the diffuser may be alleviated, improving ease of use for coupling and separation of the diffuser. The wireless power transmitter may be embedded in the outer wall of the main body to supply the power to the wireless power receiver while the first coupling portion and the second coupling portion may be coupled to each other.

The diffusing case may include a rear circumferential portion surrounding the gas inlet hole at the rear side, and the wireless power receiver may be embedded in the rear circumferential portion to receive the power from the wireless power transmitter.

The second coupling portion may further include a coupling sleeve extending rearward from the rear circumferential portion so that an inner surface of the coupling sleeve surrounds an outer surface of the front end of the main body, and the coupling sleeve may have a first magnetic force generator on the inner surface thereof to be magnetically coupled to the front end of the main body.

The first or second magnetic force generator may be located rearward of the wireless power receiver and located outward of the wireless power transmitter in a radial direction of the main body or the gas outlet. The front end of the main body may contain a magnetic substance, and the front end of the main body may be magnetically coupled to the first magnetic force generator by the magnetic substance.

The front end of the main body may include a second or first magnetic force generator, and the second coupling portion may be magnetically coupled to the first coupling portion by an attraction force between the first magnetic force generator and the second magnetic force generator. The second magnetic force generator may be embedded in the front end of the main body. The second or first magnetic force generator may be located rearward of the wireless power transmitter in the front end of the main body. At least a portion of the second magnetic force generator may be provided to overlap the first magnetic force generator along a radial direction of the gas outlet.

The diffuser may further include a light irradiator provided inside the diffusing case to irradiate light toward the front side of the diffusing case. The light irradiator may be electrically connected to the wireless power receiver to receive the power from the wireless power receiver.

The diffuser may further include a proximity sensor provided in the light irradiator to measure a separation distance from a target located in front of the diffusing case, and a controller that controls the light irradiator to irradiate the light when the separation distance from the target measured through the proximity sensor may be equal to or less than a reference distance. The wireless power receiver may be electrically connected to the proximity sensor to transmit a measured value of the proximity sensor to the wireless power transmitter, and the controller may be provided on the main body and receive the measured value of the proximity sensor through the wireless power transmitter.

Embodiments disclosed herein may provide a hair dryer capable of effectively supplying the power to the diffuser through the coupling between the diffuser and a main body. Embodiments disclosed herein may provide the hair dryer having the coupling structure in which the diffuser may be stably coupled to and effectively separated from the main body.

Embodiments disclosed herein may be implemented as a hair dryer comprising a main body including a front end, an outlet provided at the front end and through which fluid may be discharged, a first coupler provided at the front end, a wireless power transmitter provided on the first coupler and configured to wirelessly transmit power, a handle extending from the main body, and a diffuser. The diffuser may include a case having a rear end configured to be removably coupled to the main body, an inlet provided in the rear end of the case and configured to receive fluid discharged from the outlet when the rear side may be coupled to the main body, a second coupler provided at the rear end and configured to be coupled with the first coupler, and a wireless power receiver provided on the second coupler and configured to wirelessly receive power transmitted from the wireless power transmitter when the first and second couplers may be coupled.

The wireless power transmitter may be embedded in an outer wall of the front end of the main body. The wireless power receiver may be embedded in an inner wall of the rear end of the case, the inner wall having an inner surface defining the inlet.

An inner surface of the coupling sleeve may be configured to surround an outer surface of the outer wall of the front end of the main body when the first and second couplers may be coupled.

The second coupler may include a coupling sleeve extending rearward from the rear end, and a magnetic force generator provided on an inner surface of the coupling sleeve and configured to be magnetically attracted to the front end of the main body. The magnetic force generator may be farther forward than the wireless power transmitter and radially outward of the wireless power receiver in a radial direction of the main body.

The front end of the main body may contain a magnetic substance configured to be magnetically attracted to the magnetic force generator. The front end of the main body may include a secondary magnetic force generator configured to be magnetically attracted to the magnetic force generator of the coupling sleeve.

The secondary magnetic force generator may be embedded in the front end of the main body. The secondary magnetic force generator may be located radially outward of the wireless power transmitter in the front end of the main body. The first and second couplers may be coupled such that at least a portion of the secondary magnetic force generator may be provided to align with the magnetic force generator of the coupling sleeve along a radial direction of the outlet.

The diffuser may include a light provided inside the case to irradiate light away from the inlet. The light may be electrically connected to the wireless power receiver to receive the power from the wireless power receiver.

The diffuser may include a proximity sensor to measure a distance from a target located in front of the case, and a controller configured to control the light to irradiate the light when the distance from the target measured by the proximity sensor may be equal to or less than a predetermined distance.

The wireless power receiver may be electrically connected to the proximity sensor to transmit a signal representing a measurement of the proximity sensor to the wireless power transmitter. The controller may be provided on the main body and receive the signal of the proximity sensor through the wireless power transmitter.

Embodiments disclosed herein may be implemented as a diffuser for a hair dryer comprising a case having a rear end, an inlet provided at the rear end and configured to receive fluid, a coupling sleeve provided at the rear end and surrounding the inlet, the coupling sleeve being configured to be insertably coupled with and removed from a hair dryer such that the inlet receives fluid discharged from the hair dryer, a wireless power device including magnetic induction coils and provided on the coupling sleeve, the wireless power device being one of a wireless power receiver or a wireless power transceiver that may be configured to wirelessly receive power, and a magnetic force generator configured to generate a magnetic force to magnetically attract to the hair dryer. The wireless power device may be configured to power at least one of a light provided inside of the case and configured to emit light away from the inlet, a proximity sensor configured to sense a distance to a target in front of the case, or a moisture level sensor provided on a front side of the case to measure a moisture level in front of the case.

The magnetic force generator may be embedded in the coupling sleeve. The wireless power device may be embedded in the coupling sleeve. The wireless power device may be configured to transmit a signal of the proximity sensor or a signal of the moisture level sensor. At least a portion of the wireless power device and the magnetic force generator may be aligned along a radial direction of the coupling sleeve.

Although a specific embodiment of the present disclosure has been illustrated and described above, those of ordinary skill in the art to which the present disclosure pertains will appreciate that various modifications are possible within the limits without departing from the technical spirit of the present disclosure provided by the following claims.

In this specification, duplicate descriptions of the same components are omitted. Further, it will be understood that when a component is referred to as being "connected with" another component, the component may be directly connected with the other component or intervening components may also be present. In contrast, it will be understood that when a component is referred to as being "directly connected with" another component in this specification, there are no intervening components present. The terminology used herein is for the purpose of describing a specific embodiment only and is not intended to be limiting of the present disclosure. The singular forms "a" and "an" are intended to include the plural forms as well, unless the context clearly indicates otherwise.

Further, it will be further understood that the terms "comprises", "comprising", "includes", and "including" specify the presence of the certain features, numbers, steps, operations, elements, and parts or combinations thereof, but do not preclude the presence or addition of one or more other features, numbers, steps, operations, elements, and parts or combinations thereof. The term 'and/or' includes a combination of a plurality of listed items or one of the plurality of listed items. In this specification, 'A or B' may include 'A', 'B', or 'both A and B'.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer, comprising:

a main body including a front end;

an outlet provided at the front end and through which fluid is discharged;

a first coupler provided at the front end;

a wireless power transmitter provided on the first coupler, including magnetic induction coils for wireless power transmission, and configured to wirelessly transmit power;

a handle extending from the main body; and a diffuser, including:

a case having a rear end configured to be removably coupled to the main body;

an inlet provided in the rear end of the case and configured to receive fluid discharged from the outlet when the rear side is coupled to the main body;

a second coupler provided at the rear end and configured to be coupled with the first coupler;

a wireless power receiver provided on the second coupler, including magnetic induction coils for wireless power reception, and configured to wirelessly receive power transmitted from the magnetic induction coils for wireless power transmission when the first and second couplers are coupled;

a proximity sensor to measure a distance from a target located in front of the case; and a controller configured to control a light to irradiate light when the distance from the target measured by the proximity sensor is equal to or less than a predetermined distance.

2. The hair dryer of claim 1, wherein the wireless power transmitter is embedded in an outer wall of the front end of the main body.

3. The hair dryer of claim 2, wherein the wireless power receiver is embedded in an inner wall of the rear end of the case, the inner wall having an inner surface defining the inlet.

4. The hair dryer of claim 3, wherein an inner surface of a coupling sleeve of the second coupler is configured to surround an outer surface of the outer wall of the front end of the main body when the first and second couplers are coupled.

5. The hair dryer of claim 3, wherein the second coupler further includes:

a coupling sleeve extending rearward from the rear end; and a magnetic force generator provided on an inner surface of the coupling sleeve and configured to be magnetically attracted to the front end of the main body.

6. The hair dryer of claim 5, wherein the magnetic force generator is farther forward than the wireless power transmitter and radially outward of the wireless power receiver in a radial direction of the main body.

7. The hair dryer of claim 5, wherein the front end of the main body contains a magnetic substance configured to be magnetically attracted to the magnetic force generator.

8. The hair dryer of claim 5, wherein the front end of the main body includes a secondary magnetic force generator configured to be magnetically attracted to the magnetic force generator of the coupling sleeve.

9. The hair dryer of claim 8, wherein the secondary magnetic force generator is embedded in the front end of the main body.

10. The hair dryer of claim 8, wherein the secondary magnetic force generator is located radially outward of the wireless power transmitter in the front end of the main body.

11. The hair dryer of claim 8, wherein, when the first and second couplers are coupled, at least a portion of the secondary magnetic force generator is provided to align with the magnetic force generator of the coupling sleeve along a radial direction of the outlet.

12. The hair dryer of claim 1, wherein the diffuser further includes the light, which is provided inside of the case to irradiate light away from the inlet.

13. The hair dryer of claim 12, wherein the light is electrically connected to the wireless power receiver to receive power from the wireless power receiver.

14. The hair dryer of claim 1, wherein the wireless power receiver is electrically connected to the proximity sensor to transmit a signal representing a measurement of the proximity sensor to the wireless power transmitter, and wherein the controller is provided on the main body and receives the signal of the proximity sensor through the wireless power transmitter.

15. A diffuser for a hair dryer, comprising:

a case having a rear end;

an inlet provided at the rear end and configured to receive fluid;

a coupling sleeve provided at the rear end and surrounding the inlet, the coupling sleeve being configured to be insertably coupled with and removed from a hair dryer such that the inlet receives fluid discharged from the hair dryer;

a wireless power device including magnetic induction coils and provided on the coupling sleeve, the wireless power device being one of a wireless power receiver or a wireless power transceiver that is configured to wirelessly receive power; and a magnetic force generator configured to generate a magnetic force to magnetically attract to the hair dryer, wherein the wireless power device is configured to power at least one of:

a light provided inside of the case and configured to emit light away from the inlet, a proximity sensor configured to sense a distance to a target in front of the case, or a moisture level sensor provided on a front side of the case to measure a moisture level in front of the case.

16. The diffuser of claim 15, wherein the magnetic force generator is embedded in the coupling sleeve.

17. The diffuser of claim 15, wherein the wireless power device is embedded in the coupling sleeve.

18. The diffuser of claim 15, wherein the wireless power device is configured to transmit a signal of the proximity sensor or a signal of the moisture level sensor.

19. The diffuser of claim 15, wherein at least a portion of the wireless power device and the magnetic force generator are aligned along a radial direction of the coupling sleeve.

20. A hair dryer comprising the diffuser of claim 15.

* * * * *